US007675483B2

(12) United States Patent
Okuzawa

(10) Patent No.: US 7,675,483 B2
(45) Date of Patent: Mar. 9, 2010

(54) DYNAMIC FALSE CONTOUR REDUCING METHOD, DYNAMIC FALSE CONTOUR REDUCING CIRCUIT, DISPLAY DEVICE, AND PROGRAM

(75) Inventor: Masahiko Okuzawa, Kagoshima Prefecture (JP)

(73) Assignee: Panasonic Corporation, Osaka (JP)

( * ) Notice: Subject to any disclaimer, the term of this patent is extended or adjusted under 35 U.S.C. 154(b) by 979 days.

(21) Appl. No.: 10/998,166

(22) Filed: Nov. 29, 2004

(65) Prior Publication Data

US 2005/0156951 A1 Jul. 21, 2005

(30) Foreign Application Priority Data

Dec. 1, 2003 (JP) ..... 2003-402208
Sep. 28, 2004 (JP) ..... 2004-281060

(51) Int. Cl.
*G09G 3/28* (2006.01)

(52) U.S. Cl. ..... 345/63; 345/204

(58) Field of Classification Search ..... 345/60–72, 345/690–691, 589, 41–42, 204, 37; 315/169.4; 313/581
See application file for complete search history.

(56) References Cited

U.S. PATENT DOCUMENTS 6,091,396 A * 7/2000 Minami et al. ..... 345/690
6,476,875 B2 * 11/2002 Correa et al. ..... 345/691
6,812,932 B2 * 11/2004 Kasahara et al. ..... 345/63
7,265,736 B2 * 9/2007 Lee et al. ..... 345/690
2002/0135595 A1 * 9/2002 Morita et al. ..... 345/589
2004/0070590 A1 * 4/2004 Lee et al. ..... 345/690
2004/0183820 A1 * 9/2004 Kawahara et al. ..... 345/690

FOREIGN PATENT DOCUMENTS

JP 9-102921 A 4/1997
JP 2002-229510 A 8/2002
WO WO 03091975 A1 * 11/2003

OTHER PUBLICATIONS

Heijyu Uchiike, et al., "All about Plasma Display", Kogyo Chosakai Publishing Inc., May 1, 1997, 4 pages.

* cited by examiner

*Primary Examiner*—Chanh Nguyen
*Assistant Examiner*—Adam J Snyder
(74) *Attorney, Agent, or Firm*—Sughrue Mion, PLLC

(57) ABSTRACT

A dynamic false contour reducing circuit which comprises a false contour detector, an error diffusion processing part, and a display controller. The false contour detector receives an input signal for displaying an image at a pixel of interest to detect a false contour magnitude at the pixel of interest when an image is displayed at the pixel of interest based on the input signal. The error diffusion processing part performs error diffusion processing for the input signal in a manner depending on the level of the false contour magnitude detected by the false contour detector. The display controller controls a display part such that an image is displayed based on the input signal which has undergone the error diffusion processing by the error diffusion processing part.

5 Claims, 28 Drawing Sheets

7

| SF | GRADATION LEVEL |
|---|---|
| FIRST SF | |
| SECOND SF | |
| ⋮ | |
| m-TH SF | |

FIG. 8

7

| SF | GRADATION LEVEL |
|---|---|
| FIRST SF | 1 |
| SECOND SF | 2 |
| THIRD SF | 4 |
| FOURTH SF | 7 |
| FIFTH SF | 11 |
| SIXTH SF | 20 |
| SEVENTH SF | 30 |
| EIGHTH SF | 40 |
| NINTH SF | 45 |
| TENTH SF | 45 |
| ELEVENTH SF | 50 |

FIG. 9

| SF | $P_{i-1, j}$ | $P_{i, j}$ | CONTOUR DETECTION VALUE | FALSE CONTOUR DETECTION VALUE |
|---|---|---|---|---|
| FIRST SF | 0 | 0 | 0 | 0 |
| SECOND SF | 0 | 0 | 0 | 0 |
| THIRD SF | 4 | 4 | 0 | 0 |
| FOURTH SF | 0 | 7 | 1 | 7 |
| FIFTH SF | 0 | 0 | 0 | 0 |
| SIXTH SF | 0 | 0 | 0 | 0 |
| SEVENTH SF | 0 | 0 | 0 | 0 |
| EIGHTH SF | 0 | 0 | 0 | 0 |
| NINTH SF | 0 | 0 | 0 | 0 |
| TENTH SF | 0 | 0 | 0 | 0 |
| ELEVENTH SF | 0 | 0 | 0 | 0 |

FIG. 10

| SF | $P_{i-1, j}$ | $P_{i, j}$ | CONTOUR DETECTION VALUE | FALSE CONTOUR DETECTION VALUE |
|---|---|---|---|---|
| FIRST SF | 0 | 0 | 0 | 0 |
| SECOND SF | 0 | 0 | 0 | 0 |
| THIRD SF | 4 | 0 | 1 | 4 |
| FOURTH SF | 0 | 0 | 0 | 0 |
| FIFTH SF | 0 | 11 | 1 | 11 |
| SIXTH SF | 0 | 0 | 0 | 0 |
| SEVENTH SF | 0 | 0 | 0 | 0 |
| EIGHTH SF | 0 | 0 | 0 | 0 |
| NINTH SF | 0 | 0 | 0 | 0 |
| TENTH SF | 0 | 0 | 0 | 0 |
| ELEVENTH SF | 0 | 0 | 0 | 0 |

9

| GRADATION LEVEL OF PIXEL OF INTEREST | FALSE CONTOUR MAGNITUDE | VIEWED FALSE CONTOUR MAGNITUDE |
|---|---|---|
| | | |
| | | |
| ⋮ | ⋮ | ⋮ |
| | | |

FIG. 18

19

| FIRST GRADATION LEVEL RANGE (FLAG "0") | SECOND GRADATION LEVEL RANGE (FLAG "1") | SELECTION INFORMATION |
|---|---|---|
| 0 – 45 | 56 – 75 | 0 |
| 56 – 75 | 96 – 115 | 0 |
| 96 – 115 | 141 – 160 | 0 |
| 141 – 160 | 176 – 205 | 0 |
| 176 – 205 | 216 – 255 | 0 |

FIG. 20

| SF | Pi-1, j | Pi, j | CONTOUR DETECTION VALUE | FALSE CONTOUR DETECTION VALUE |
|---|---|---|---|---|
| FIRST SF | 0 | 1 | 1 | 1 |
| SECOND SF | 2 | 2 | 0 | 0 |
| THIRD SF | 4 | 4 | 0 | 0 |
| FOURTH SF | 0 | 0 | 0 | 0 |
| FIFTH SF | 0 | 0 | 0 | 0 |
| SIXTH SF | 20 | 20 | 0 | 0 |
| SEVENTH SF | 30 | 30 | 0 | 0 |
| EIGHTH SF | 0 | 0 | 0 | 0 |
| NINTH SF | 0 | 0 | 0 | 0 |
| TENTH SF | 0 | 0 | 0 | 0 |
| ELEVENTH SF | 0 | 0 | 0 | 0 |

FIG. 21

| SF | $P_{i-1, j}$ | $P_{i, j}$ | CONTOUR DETECTION VALUE | FALSE CONTOUR DETECTION VALUE |
|---|---|---|---|---|
| FIRST SF | 0 | 0 | 0 | 0 |
| SECOND SF | 2 | 0 | 1 | 2 |
| THIRD SF | 4 | 0 | 1 | 4 |
| FOURTH SF | 0 | 7 | 1 | 7 |
| FIFTH SF | 0 | 0 | 0 | 0 |
| SIXTH SF | 20 | 20 | 0 | 0 |
| SEVENTH SF | 30 | 30 | 0 | 0 |
| EIGHTH SF | 0 | 0 | 0 | 0 |
| NINTH SF | 0 | 0 | 0 | 0 |
| TENTH SF | 0 | 0 | 0 | 0 |
| ELEVENTH SF | 0 | 0 | 0 | 0 |

FIG. 22

| SF | $P_{i-1, j}$ | $P_{i, j}$ | CONTOUR DETECTION VALUE | FALSE CONTOUR DETECTION VALUE |
|---|---|---|---|---|
| FIRST SF | 1 | 1 | 0 | 0 |
| SECOND SF | 2 | 2 | 0 | 0 |
| THIRD SF | 4 | 4 | 0 | 0 |
| FOURTH SF | 7 | 7 | 0 | 0 |
| FIFTH SF | 11 | 11 | 0 | 0 |
| SIXTH SF | 20 | 20 | 0 | 0 |
| SEVENTH SF | 30 | 30 | 0 | 0 |
| EIGHTH SF | 40 | 40 | 0 | 0 |
| NINTH SF | 45 | 45 | 0 | 0 |
| TENTH SF | 45 | 45 | 0 | 0 |
| ELEVENTH SF | 0 | 0 | 0 | 0 |

FIG. 23

| SF | Pi-1, j | Pi, j | CONTOUR DETECTION VALUE | FALSE CONTOUR DETECTION VALUE |
|---|---|---|---|---|
| FIRST SF | 1 | 1 | 0 | 0 |
| SECOND SF | 2 | 0 | 1 | 2 |
| THIRD SF | 4 | 4 | 0 | 0 |
| FOURTH SF | 7 | 0 | 1 | 7 |
| FIFTH SF | 11 | 11 | 0 | 0 |
| SIXTH SF | 20 | 20 | 0 | 0 |
| SEVENTH SF | 30 | 0 | 1 | 30 |
| EIGHTH SF | 40 | 40 | 0 | 0 |
| NINTH SF | 45 | 45 | 0 | 0 |
| TENTH SF | 45 | 45 | 0 | 0 |
| ELEVENTH SF | 0 | 50 | 1 | 50 |

FIG. 24

| SF | $P_{i-1, j}$ | $P_{i, j}$ | CONTOUR DETECTION VALUE | FALSE CONTOUR DETECTION VALUE |
|---|---|---|---|---|
| FIRST SF | 1 | 0 | 1 | 1 |
| SECOND SF | 2 | 2 | 0 | 0 |
| THIRD SF | 4 | 4 | 0 | 0 |
| FOURTH SF | 7 | 0 | 1 | 7 |
| FIFTH SF | 11 | 0 | 1 | 11 |
| SIXTH SF | 20 | 0 | 1 | 20 |
| SEVENTH SF | 30 | 30 | 0 | 0 |
| EIGHTH SF | 40 | 40 | 0 | 0 |
| NINTH SF | 45 | 45 | 0 | 0 |
| TENTH SF | 45 | 45 | 0 | 0 |
| ELEVENTH SF | 0 | 50 | 1 | 50 |

FIRST THRESHOLD < $f_2$ → INTENSE

SECOND THRESHOLD < $f_2$ ≤ FIRST THRESHOLD → MODERATE $f_2$ ≤ SECOND THRESHOLD → FEEBLE

FIG. 31

48

| FIRST GRADATION LEVEL RANGE (FLAG "0") | SECOND GRADATION LEVEL RANGE (FLAG "1") | SELECTION INFORMATION (0/1) |
|---|---|---|
| 0 – 25 | 36 – 42 | 0 |
| 36 – 42 | 60 – 66 | 0 |
| 60 – 66 | 92 – 98 | 0 |
| 92 – 98 | 133 – 139 | 0 |
| 133 – 139 | 185 – 191 | 0 |
| 185 – 191 | 249 – 255 | 0 |

FIG. 32

49

| FIRST GRADATION LEVEL RANGE (FLAG "0") | SECOND GRADATION LEVEL RANGE (FLAG "1") | SELECTION INFORMATION (0/1) |
|---|---|---|
| 0 – 42 | 50 – 66 | 0 |
| 50 – 66 | 82 – 98 | 0 |
| 82 – 98 | 123 – 139 | 0 |
| 123 – 139 | 175 – 191 | 0 |
| 175 – 191 | 239 – 255 | 0 |

DYNAMIC FALSE CONTOUR REDUCING METHOD, DYNAMIC FALSE CONTOUR REDUCING CIRCUIT, DISPLAY DEVICE, AND PROGRAM

BACKGROUND OF THE INVENTION

1. Field of the Invention

The present invention relates to a dynamic false contour reducing method, a dynamic false contour reducing circuit, a display device, and a program for displaying an image on a display based on display data.

2. Description of the Related Art

A display device displays an image based on an input signal (display data) on a display part. The input signal is a signal for displaying an image at a pixel Pi,j. As shown in FIG. 1, the display device is sequentially applied with input signals (display data) corresponding to a pixel Pi−4, a pixel Pi−3, a pixel Pi−2, a pixel Pi−1, a pixel Pi, a pixel Pi+1, a pixel Pi+2, a pixel Pi+3, where i is an arbitrary integer.

The display device can display a moving image in accordance with display data on the display. Here, each pixel is comprised of one subfield which has a first SF (subfield) to an eighth SF. A gradation level is set to each of the first SF to eighth SF of each pixel for indicating the depth of three colors, R (red), G (green), and B (blue). For example, when a gradation level representative of unlit state (black) is set to each of the first SF to eighth SF of a pixel Pi, the gradation level of the pixel Pi indicates zero. When a gradation level representative of lit state (other than black) is set to at least one of the first SF to eighth SF of the pixel Pi as a pixel of interest, the gradation level of the pixel Pi indicates a range from one to 255.

In the example shown in FIG. 1, a gradation level representative of lit state (white display in FIG. 1) is set to the first SF to seventh SF of the pixel Pi−4, pixel Pi−3, pixel Pi−2, and pixel Pi−1, while a gradation level representative of unlit state (black display in FIG. 1) is set to the eighth SF of the pixel Pi−4, pixel Pi−3, pixel Pi−2, and pixel Pi−1. The gradation level representative of unlit state (black display in FIG. 1) is set to the first SF to seventh SF of the pixel Pi, pixel Pi+1, pixel Pi+2, and pixel Pi+3, while the gradation level representative of lit state (white display in FIG. 1) is set to the eighth SF of the pixel Pi, pixel Pi+1, pixel Pi+2, and pixel Pi+3. When a moving image is displayed on the display part, display data is displayed at positions corresponding to the pixel Pi−4, pixel Pi−3, pixel Pi−2, and pixel Pi−1 of the display part in the order of the first SF to seventh SF (lit) and the eighth SF (unlit). Also, display data is displayed at positions corresponding to the pixel Pi, pixel Pi+1, pixel Pi+2, and pixel Pi+3 of the display part in the order of the first SF to seventh SF (unlit) and the eighth SF (lit).

When a user views a moving image displayed on the display part, a dynamic false contour 100 appears as shown in FIG. 1. The dynamic false contour is described in "All about Plasma Display" written by Heijyu Uchiike and Shigeo Mikoshiba, pp. 164-165, Kogyo Chosakai Publishing Inc., May 1, 1997. When the dynamic false contour 100 appears, a still image displayed on the display part is affected as well. It is desired to reduce the dynamic false contour 100.

There is known a driver for a selfluminous display panel which generates less dynamic false contours (see Japanese Patent Application kokai No. 9-102921 (Patent Document 1)). According to the technique described in Patent Document 1, for driving a selfluminous display panel in accordance with a subfield method to display an image in gradations, display data of the image is corrected based on false contours caused by the subfield method. The display panel driver described in Patent Document 1 is characterized by comprising determining means, and correction selecting means. The determining means determines the presence or absence of a false contour on a pixel-by-pixel basis based on fluctuations between frames for the same pixel and fluctuations between pixels for the same frame. The correction selecting means selectively corrects the display data in accordance with the result of the determination.

The false contours are not sufficiently reduced only by selectively correcting display data simply in accordance with the result of determination as to the presence or absence of a false contour, as is the case with the display panel driver described in Patent Document 1.

Japanese Patent Application Kokai No. 2002-229510 (Patent Document 2), for example, describes a prior art example which is made in view of the problem mentioned above. Patent Document 2 describes generating a plurality of candidate pixel signals for each pixel of interest, and selecting the candidate signal which exhibits the smallest magnitude of false contour of the plurality of candidate pixel signals for a display operation.

Other than Laid-open Japanese Patent Applications Nos. 9-102921 and 2002-229510, there is "All about Plasma Display," written by Heijyu Uchiike and Shigeo Mikoshiba, pp. 164-165, Kogyo Chosakai Publishing Inc., May 1, 1997.

SUMMARY OF THE INVENTION

It is an object of the present invention to provide a dynamic false contour reducing method, a dynamic false contour reducing circuit, a display device, and a program which are capable of reducing dynamic false contours more suitably than the prior art.

It is another object of the present invention to provide a dynamic false contour reducing method, a dynamic false contour reducing circuit, a display device, and a program which are capable of displaying an image in accordance with an input signal (input data) more precisely than the prior art.

A dynamic false contour reducing method according to the present invention is characterized by comprising a detection step for applying an input signal for displaying an image at a pixel of interest to detect a false contour magnitude at the pixel of interest when the image is displayed at the pixel of interest based on the input signal, and an error diffusion step for performing error diffusion processing for the input signal in a manner depending on the level of the false contour magnitude detected in the detection step.

Another method of reducing a false contour in a moving image according to the present invention is characterized by comprising the steps of applying an input signal for displaying an image at a pixel of interest, and determining gradation levels of a plurality of determined subfields in accordance with the input signal with reference to a gradation level setting memory which corresponds a plurality of subfields to a plurality of gradation levels, such that a total value of the gradation levels represents a gradation level of the pixel of interest, detecting a contour of the pixel of interest with peripheral pixels around the pixel of interest to generate a contour detection value for each of the determined subfields, multiplying gradation levels corresponding to the subfields stored in the gradation level setting memory by the contour detection values for each of the determined subfields to generate false contour detection values, calculating a total value of the false contour detection values generated for the respective determined subfields as a false contour magnitude indicative of the degree of a dynamic false contour, referring to a visual sensitivity setting memory which corresponds the gradation level of the pixel of interest to a viewed false contour magnitude felt by a user when the user actually views the gradation level of the pixel of interest displayed on a display part to search for the viewed false contour magnitude corresponding to the gradation level of the pixel of interest and the false contour magnitude, and performing error diffusion processing for the input signal in a manner depending on the level of the viewed false contour magnitude retrieved in the step of searching.

A dynamic false contour reducing circuit according to the present invention is characterized by comprising a false contour detector for receiving an input signal for displaying an image at a pixel of interest to detect a false contour magnitude at the pixel of interest when the image is displayed at the pixel of interest based on the input signal, an error diffusion processing part for performing error diffusion processing for the input signal in a manner depending on the level of the false contour magnitude detected by the false contour detector, and a display controller for controlling a display part such that an image is displayed based on the input signal after the input signal is subjected to error diffusion processing by the error diffusion processing part.

Another circuit for reducing a false contour in a moving image according to the present invention is characterized by comprising a gradation level setting memory for corresponding a plurality of subfields to a plurality of gradation levels, a coding part for receiving an input signal for displaying an image at a pixel of interest, and determining gradation levels of a plurality of determined subfields in accordance with the input signal with reference to the gradation level setting memory, such that a total value of the gradation levels represents a gradation level of the pixel of interest, a contour detector for detecting a contour of the pixel of interest with peripheral pixels around the pixel of interest to generate a contour detection value for each of the determined subfields, a weighting part for multiplying gradation levels corresponding to the subfields stored in the gradation level setting memory by the contour detection values for each of the determined subfields to generate false contour detection values, an adder for calculating a total value of the false contour detection values generated for the respective determined subfields as a false contour magnitude indicative of the degree of a dynamic false contour, a visual sensitivity setting memory for corresponding the gradation level of the pixel of interest to a viewed false contour magnitude felt by a user when the user actually views the gradation level of the pixel of interest displayed on a display part, a visual sensitivity conversion part for searching for the viewed false contour magnitude corresponding to the gradation level of the pixel of interest and the false contour magnitude with reference to the visual sensitivity setting memory, and an error diffusion processing part for performing error diffusion processing for the input signal in a manner depending on the level of the viewed false contour magnitude retrieved by the visual sensitivity conversion part, and a display controller for controlling a display part such that an image is displayed based on the input signal after the input signal has undergone the error diffusion processing by the error diffusion processing part.

A display device according to the present invention is characterized by comprising the circuit for reducing a false contour in a moving image according to the present invention, and a display part connected to the circuit for reducing a false contour in a moving image.

A program according to the present invention is a program executable by a computer, characterized by executing detection processing for applying an input signal for displaying an image at a pixel of interest to detect a false contour magnitude at the pixel of interest when the image is displayed at the pixel of interest based on the input signal, and error diffusion processing for performing error diffusion processing for the input signal in a manner depending on the level of the false contour magnitude detected in the detection processing.

Another program according to the present invention is a program executable by a computer, characterized by executing determination processing for determining gradation levels of a plurality of determined subfields in accordance with an input signal applied for displaying an image at a pixel of interest with reference to a gradation level setting memory which corresponds a plurality of subfields to a plurality of gradation levels, such that a total value of the gradation levels represents a gradation level of the pixel of interest, processing for detecting a contour of the pixel of interest with peripheral pixels around the pixel of interest to generate a contour detection value for each of the determined subfields, processing for multiplying gradation levels corresponding to the subfields stored in the gradation level setting memory by the contour detection values for each of the determined subfields to generate false contour detection values, processing for calculating a total value of the false contour detection values generated for the respective determined subfields as a false contour magnitude indicative of the degree of a dynamic false contour, search processing for referring to a visual sensitivity setting memory which corresponds the gradation level of the pixel of interest to a viewed false contour magnitude felt by a user when the user actually views the gradation level of the pixel of interest displayed on a display part to search for the viewed false contour magnitude corresponding to the gradation level of the pixel of interest and the false contour magnitude, and error diffusion processing for performing error diffusion processing for the input signal in a manner depending on the level of the viewed false contour magnitude retrieved in the search processing.

According to the dynamic false contour reducing method, dynamic false contour reducing circuit, display device, and program, dynamic false contours can be more suitably reduced than the prior art.

According to the dynamic false contour reducing method, dynamic false contour reducing circuit, display device, and program, an image can be precisely displayed in accordance with an input signal (display data).

BRIEF DESCRIPTION OF THE DRAWINGS

FIG. 8 is a diagram showing contents stored in the gradation level setting memory within the dynamic false contour reducing circuit in the first embodiment of the display device according to the present invention;

FIG. 9 is a diagram for explaining the operation of the first embodiment of the display device according to the present invention;

FIG. 10 is a diagram for explaining the operation of the first embodiment of the display device according to the present invention;

FIG. 18 is a diagram showing contents stored in a range selection memory within the dynamic false contour reducing circuit in the second embodiment of the display device according to the present invention;

FIG. 20 is a diagram for explaining the operation of the second embodiment of the display device according to the present invention;

FIG. 21 is a diagram for explaining the operation of the second embodiment of the display device according to the present invention;

FIG. 22 is a diagram for explaining the operation of the second embodiment of the display device according to the present invention;

FIG. 23 is a diagram for explaining the operation of the second embodiment of the display device according to the present invention;

FIG. 24 is a diagram for explaining the operation of the second embodiment of the display device according to the present invention;

FIG. 31 is a diagram for explaining the operation of the third embodiment of the display device according to the present invention; and FIG. 32 is a diagram for explaining the operation of the third embodiment of the display device according to the present invention.

DETAILED DESCRIPTION OF THE INVENTION

The best mode for carrying out a dynamic false contour reducing method according to the present invention will be described below with reference to the accompanying drawings.

First Embodiment

Figure 1:
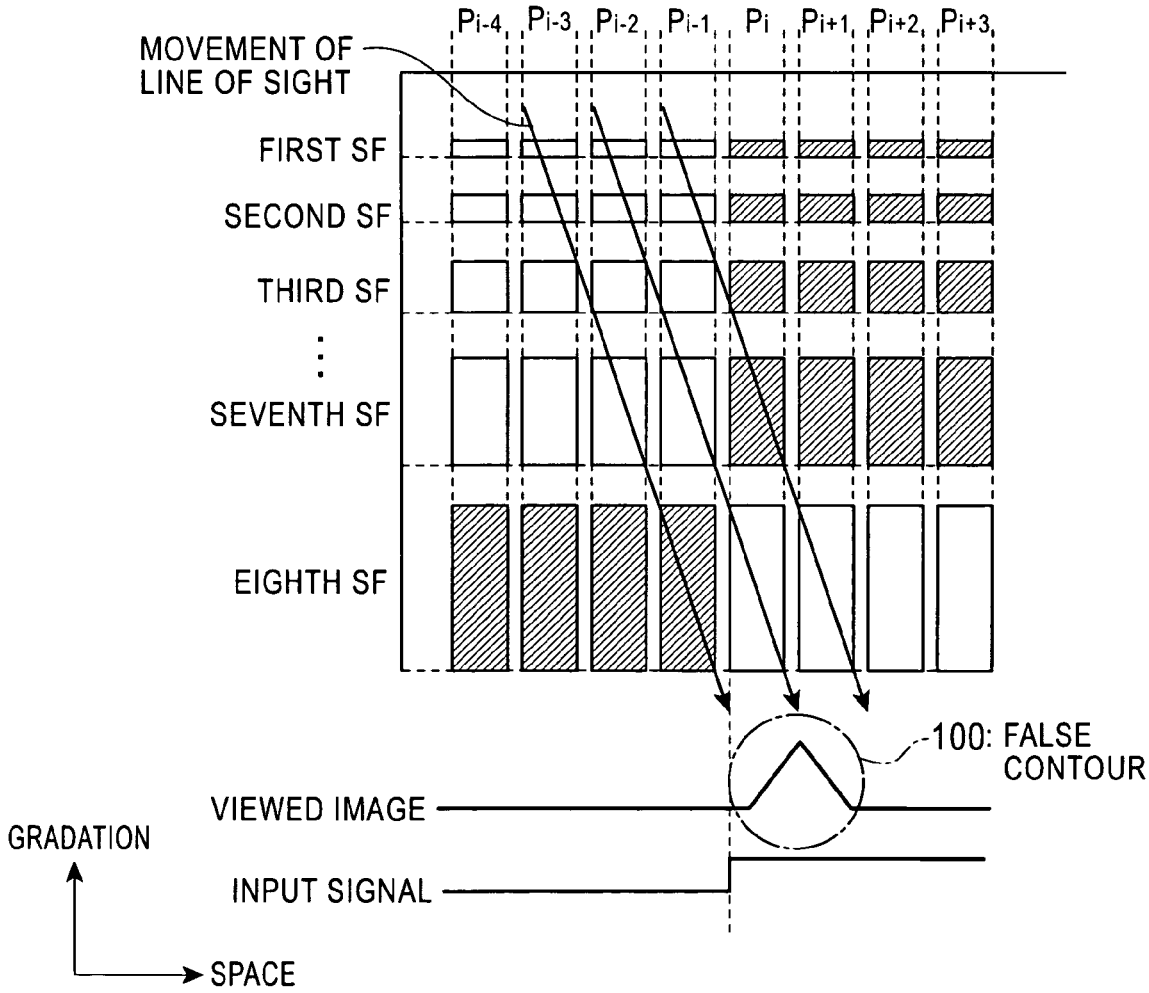
FIG. 1 is a diagram for explaining a false contour in the background art.
Figure 2:
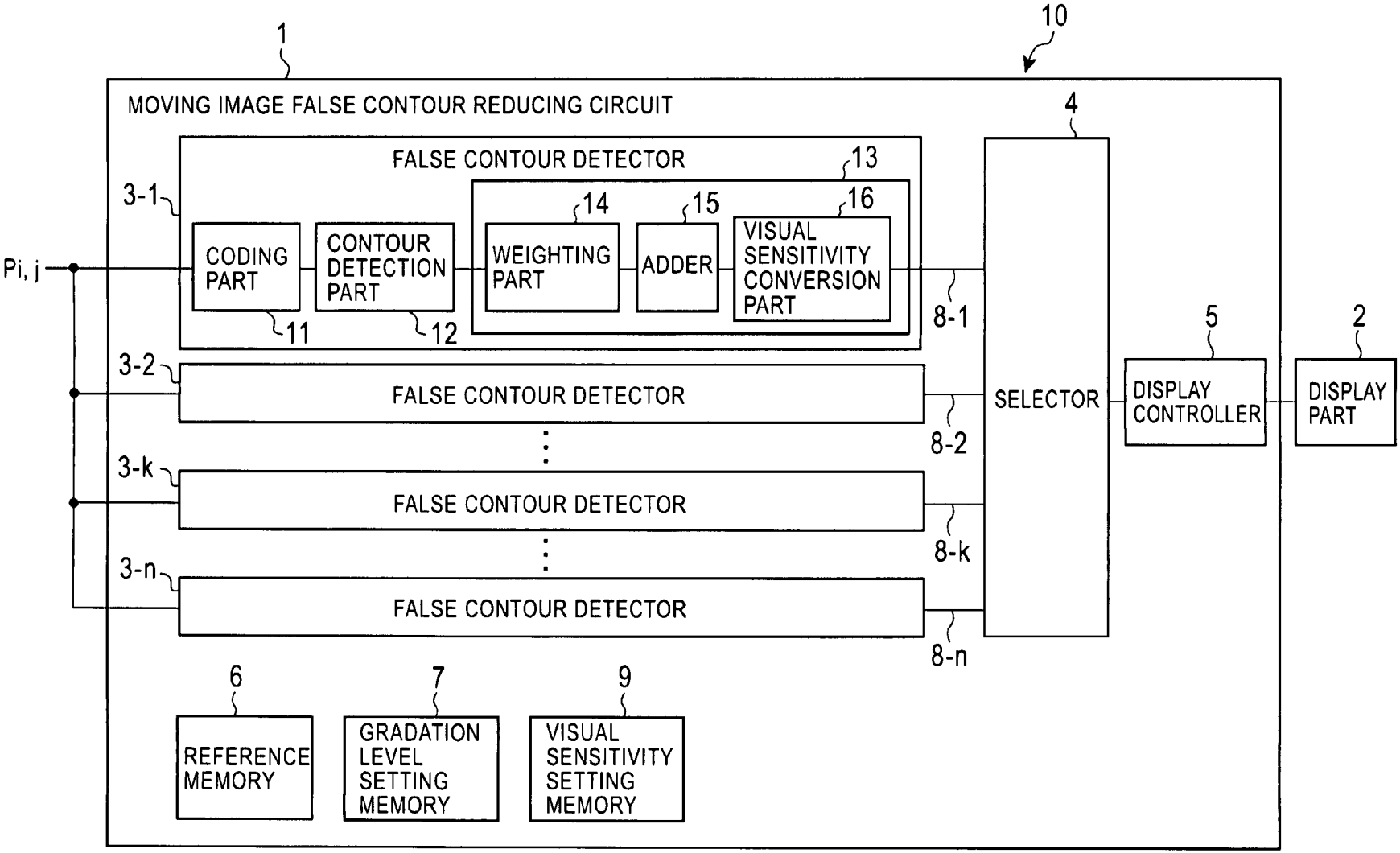
FIG. 2 is a block diagram showing the configuration of a first embodiment of a display device according to the present invention.

A dynamic false contour reducing method according to a first embodiment of the present invention is implemented by a display device 10 as shown in FIG. 2. FIG. 2 is a block diagram showing the configuration of the display device 10 according to the first embodiment of the present invention. The display device 10 according to the first embodiment of the present invention comprises a dynamic false contour reducing circuit 1, and a display part 2 connected to the dynamic false contour reducing circuit 1. A plasma display is illustrated as the display part 2.

Figure 3:
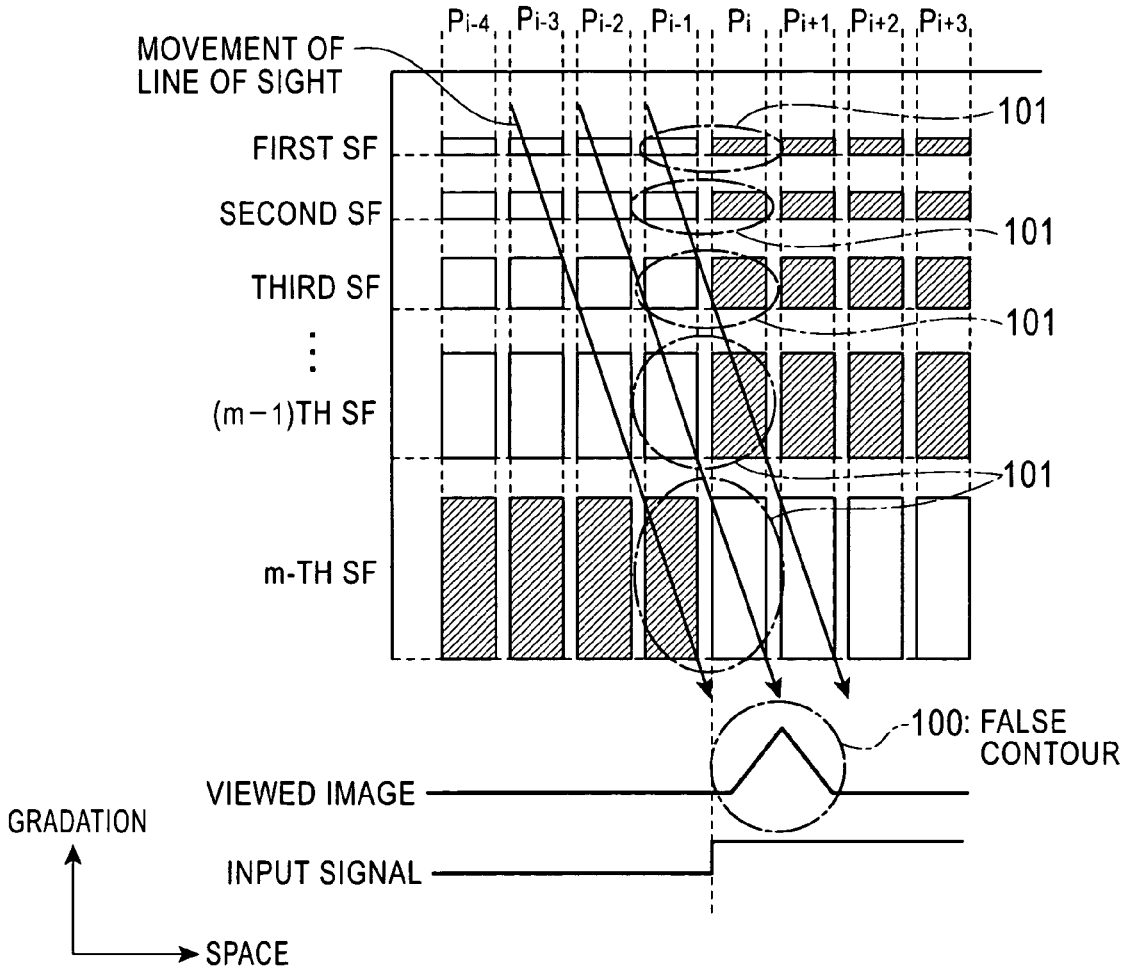
FIG. 3 is a diagram for explaining a false contour in the first embodiment.

The display part 2 has a plurality of pixels arranged in a matrix form. The dynamic false contour reducing circuit 1 is applied with an input signal for displaying an image at a pixel Pi,j as display data, where i is an arbitrary integer representative of an address in the horizontal direction of the display part 2, and j is an arbitrary integer representative of an address in the vertical direction of the display part 2. For example, as shown in FIG. 3, the dynamic false contour reducing circuit 1 is sequentially applied with input signals (display data) corresponding to a pixel Pi−4,j, a pixel Pi−3,j, a pixel Pi−2,j, a pixel Pi−1,j, a pixel Pi,j, a pixel Pi+1,j, a pixel Pi+2,j, and a pixel Pi+3,j. When each pixel is displayed on the display part 2, the pixel Pi−3,j adjoins the pixel Pi−4,j; the pixel Pi−2,j adjoins the pixel Pi−3,j; the pixel Pi−1,j adjoins the pixel Pi−2,j; the pixel i,j adjoins the pixel Pi−1,j; the pixel Pi+1,j adjoins the pixel Pi,j; the pixel Pi+2,j adjoins the Pixel Pi,j+1; and the pixel Pi+3,j adjoins the pixel Pi,j+2.

The display device 10 according to the first embodiment of the present invention can display the display data on the display part 2 as a moving image. Here, each pixel is comprised of one subfield, and one subfield has a first SF (subfield) to an n-th SF, where n is, for example, an integer equal to or more than eight. A gradation level indicative of the depth of three colors, R (red), G (green), B (blue) is set to each of the first SF to n-th SF of each pixel. For example, when a gradation level representative of unlit state (black) is set to each of the first SF to n-th SF of a pixel Pi, the gradation level of the pixel Pi represents zero. When a gradation level representative of lit state (other than black) is set to at least one of the first SF to n-th SF of the pixel Pi as a pixel of interest, the gradation level of the pixel Pi represents a range from one to 255.

In the example shown in FIG. 3, for example, the gradation level representative of lit state (white display in FIG. 3) is set to the first to (m−1)th SF of the pixel Pi−4,j, pixel Pi−3,j, pixel Pi−2,j, and pixel Pi−1,j; the gradation level representative of unlit state (black display in FIG. 3) is set to the m-th SF of the pixel Pi−4,j, pixel Pi−3,j, pixel Pi−2,j, and pixel Pi−1,j; the gradation level representative of unlit state (black display in FIG. 3) is set to the first SF to (m−1)th SF of the pixel Pi,j, pixel Pi+1,j, pixel Pi+2,j, and pixel Pi+3,j; and the gradation level representative of lit state (white display in FIG. 3) is set to the m-th SF of the pixel Pi,j, pixel Pi+1,j, pixel Pi+2,j, and pixel Pi+3,j.

Supposing that an input signal (display data) is directly input to the display part 2 without passing through the dynamic false contour reducing circuit 1 to display a moving image on the display part 2, a display operation is performed in the order of the first SF to (m−1)th SF (lit) and the m-th SF (unlit) at positions (addresses) corresponding to the pixel Pi−4,j, pixel Pi−3,j, pixel Pi−2,j, and pixel Pi−1,j of the display part 2. Also, the display operation is performed in the order of the first SF to (m−1)th SF (unlit) and the m-th SF (lit) at positions (addresses) corresponding to the pixel Pi,j, pixel Pi+1,j, pixel Pi+2,j, and pixel Pi+3,j of the display part 2.

When the input signal (display data) is directly input to the display part 2 without passing through the dynamic false contour reducing circuit 1 to display a moving image on the display part 2, a dynamic false contour 100 appears, when the user views the moving image, as shown in FIG. 3. When the dynamic false contour 100 appears, a still image displayed on the display part 2 is affected as well.

When the user actually views the gradation level of the pixel of interest Pi,j on the display part 2, the user may feel the gradation level as if it were higher. The dynamic false contour reducing method according to the first embodiment of the present invention more precisely reduces the dynamic false contour 100 than the prior art by taking into account the magnitude of the false contour which is felt by the user when he actually views it.

As shown in FIG. 2, the dynamic false contour reducing circuit 1 comprises a plurality of false contour detectors 3-1 to **3-*n* (n is an integer equal to or more than two), a selector 4, and a display controller 5**.

The plurality of false contour detectors 3-1 to **3-*n* are applied with an input signal for displaying an image at a pixel Pi,j, which is a pixel of interest, and generate candidate pixel signals 8-1 to 8-*n*, respectively, for the input signal (pixel Pi,j), and output the candidate pixel signals 8-1 to 8-*n* to the selector 4**.

The false contour detector 3-1 of the plurality of false contour detectors 3-1 to **3-*n* outputs the candidate pixel signal 8-1 of the plurality of candidate pixel signals 8-1 to 8-*n* to the selector 4. The gradation level represented by the candidate pixel signal 801 represents the gradation level of the input signal (pixel Pi,j). The gradation level represented by the candidate pixel signal 8-1 represents the total value of gradation levels of subfields in the first SF to m-th SF of the candidate pixel signal 8-1, which is set to a gradation level representative of lit state (other than black). The candidate pixel signal 8-1 is designated a false contour magnitude $f_2$ which indicates the degree of a viewed dynamic false contour. The viewed false contour magnitude $f_2$ is the false contour magnitude which is felt by the user when he actually views a gradation level of a pixel of interest displayed on the display part 2**.

A false contour detector **3-*k* (k=1, 2, . . . , n) of the plurality of false contour detectors 3-1 to 3-*n* outputs a candidate pixel signal 8-*k* of the plurality of candidate pixel signals 8-1 to 8-*n* to the selector 4. The gradation level represented by the candidate pixel signal 8-*k* represents the gradation level of the input signal (pixel Pi,j). The gradation level represented by the candidate pixel signal 8-*k* represents the total value of gradation levels of subfields in the first SF to m-th SF of the candidate pixel signal 8-*k*, which is set to a gradation level representative of lit state (other than black) is set. The candidate pixel signal 8-*k*** is also designated a false contour magnitude $f_2$ which indicates the degree of a viewed dynamic false contour.

The selector 4 selects the candidate pixel signal having the smallest false contour magnitude $f_2$ from among the false contour magnitudes $f_2$ exhibited by the respective candidate pixel signals 8-1 to **8-*n*. The display controller 5 controls the display part 2** such that the selected candidate pixel signal is displayed as an input signal (pixel Pi, j).

In the display device 10 according to the first embodiment of the present invention, the moving false contour reducing circuit 1 selects the candidate pixel signal, which has the smallest viewed false contour magnitude f2, from the false contour magnitudes $f_2$ exhibited by the plurality of candidate pixel signals 8-1 to **8-*n*, and displays the selected candidate pixel signal on the display part 2 as an input signal (pixel of interest Pi,j), thus making it possible to more suitably reduce the dynamic false contour 100, as compared with the prior art which reduces false contours using a false contour magnitude $f_1$ which is simply found without taking into account a viewed false contour. In other words, the display device 10 according to the first embodiment of the present invention eliminates a degraded image quality of an image (moving image or still image) displayed on the display part 2**.

As shown in FIG. 2, the dynamic false contour reducing circuit 1 further comprises a reference memory 6 and a gradation level setting memory 7.

Figure 4:
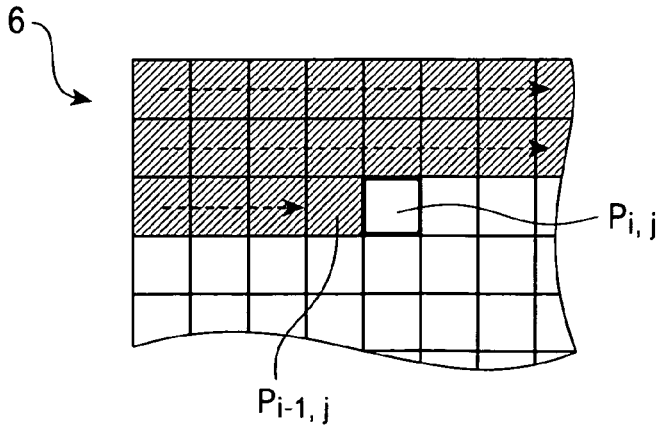
FIG. 4 is a diagram showing pixels stored in a reference memory within a dynamic false contour reducing circuit of the first embodiment of the display device according to the present invention.

As shown in FIG. 4, the reference memory 6 stores an input signal applied thereto by the selector 4. The input signal stored in the reference memory 6 is an input signal for displaying an image at peripheral pixels (pixel Pi−4,j, pixel Pi−3,j, pixel Pi−2,j, pixel Pi−1,j). The peripheral pixels (pixel Pi−4,j, pixel Pi−3,j, pixel Pi−2,j, pixel Pi−1,j) are pixels (a shaded portion in FIG. 4) displayed on the display part 2 by the display controller 5.

Figures 5, 6:
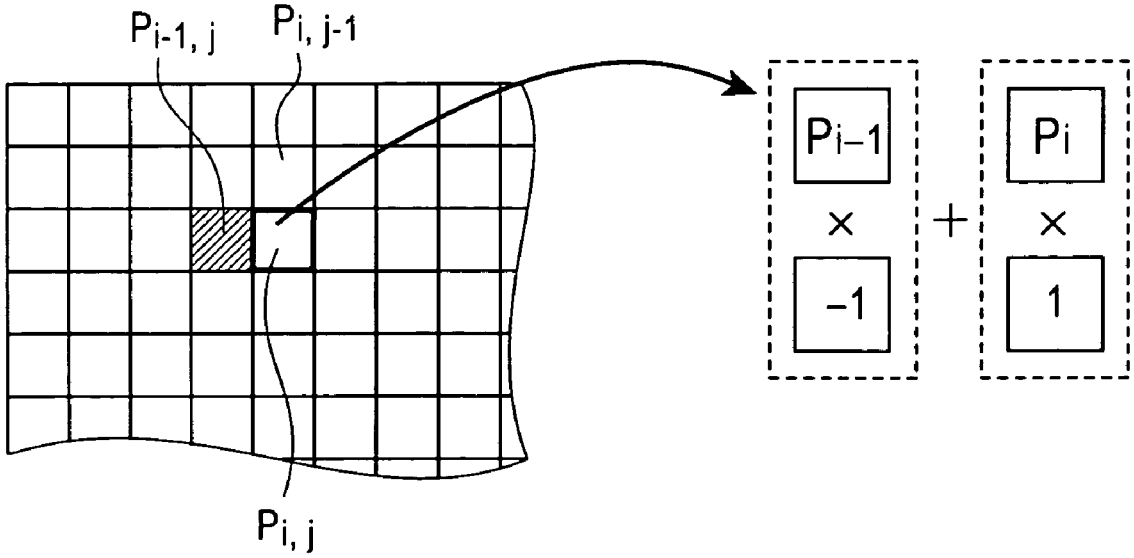
FIG. 5 is a diagram showing contents stored in a gradation level setting memory within the dynamic false contour reducing circuit of the first embodiment of the display device according to the present invention.
FIG. 6 is a diagram for explaining detection of a contour, performed by a contour detector within the dynamic false contour reducing circuit of the first embodiment of the display device according to the present invention.

As shown in FIG. 5, the gradation level setting memory 7 stores a plurality of subfields (first SF to m-th SF) and a plurality of gradation levels in correspondence to each other. The total value of the gradation levels of the first SF to m-th SF amounts to 255.

The configuration of the false contour detector **3-*k* will be described with reference to FIGS. 2 to 7. As shown in FIG. 2, the false contour detector 3-*k* comprises a coding part 11, a contour detecting part 12, and a false contour magnitude generation part 13**.

The coding part 11 of the false contour detector **3-*k* determines a plurality of determined subfields (first SF to m-th SF) with reference to the gradation level setting memory 7**. The total value of the gradation levels of the plurality of determined subfields (first SF to m-th SF) represents a gradation level of the pixel Pi,j.

The contour detection part 12 of the false contour detector **3-*k* detects a contour of a pixel of interest (pixel Pi,j) represented by an input signal with peripheral pixels around the pixel of interest (pixel Pi,j) with reference to the reference memory 6**. An exemplary method of detecting a contour may involve examining the presence or absence of a difference in level between the pixel of interest (pixel Pi,j) and the peripheral pixels.

A brief description will be given to the method of examining the presence or absence of a difference in level between the pixel of interest (pixel Pi,j) and the peripheral pixels. The peripheral pixels include a pixel Pi−1,j which adjoins the pixel Pi,j in the horizontal direction, and a pixel Pi,j−1 which adjoins the pixel Pi,j in the vertical direction. The contour detection part 12 comprises a filter for calculating the difference in level between the pixel of interest (pixel Pi,j) and each of the peripheral pixels.

For calculating the difference in level between the pixel Pi,j and pixel Pi−1,j, the filter of the contour detection part 12 multiplies the level of the pixel Pi−1,j by −1, multiplies the level of the pixel Pi,j by +1, and sums up the level of the pixel i,j and the level of the pixel Pi−1,j for each of the determined subfields (first SF to m-th SF), as shown in FIG. 6.

For calculating the difference in level between the pixel Pi,j and pixel Pi,j−1, the filter of the contour detection part 12 multiplies the level of the pixel Pi,j−1 by −1, multiplies the level of the pixel Pi,j by +1, and sums up the level of the pixel Pi,j and the level of the pixel Pi,j−1 for each of the determined subfields (first SF to m-th SF), as shown in FIG. 6.

In the following description, assume that the contour detection part 12 has calculated the difference in level between the pixel Pi,j and pixel Pi−1,j. For example, as shown in FIG. 3, there is a difference in level 101 in the first SF to m-th SF of the pixel Pi,j and pixel Pi−1,j. For reducing the dynamic false contour 100, it is preferable that there are fewer subfields which entail the difference in level 101. The contour detection part 12 generates a contour detection value indicative of the presence or absence of the difference in level 101 between the pixel Pi,j and pixel Pi−1,j for each of the determined subfields (first SF to m-th SF).

The false contour magnitude generation part 13 of the false contour detector 3-*k* generates the viewed false contour magnitude $f_2$ based on the contour detection value generated for each of the determined subfields (first SF to m-th SF). The false contour magnitude generation part 13 outputs the input signal (pixel Pi,j) having the false contour magnitude $f_2$ to the selector 4 as a candidate pixel signal 8-*k*.

Figure 7:
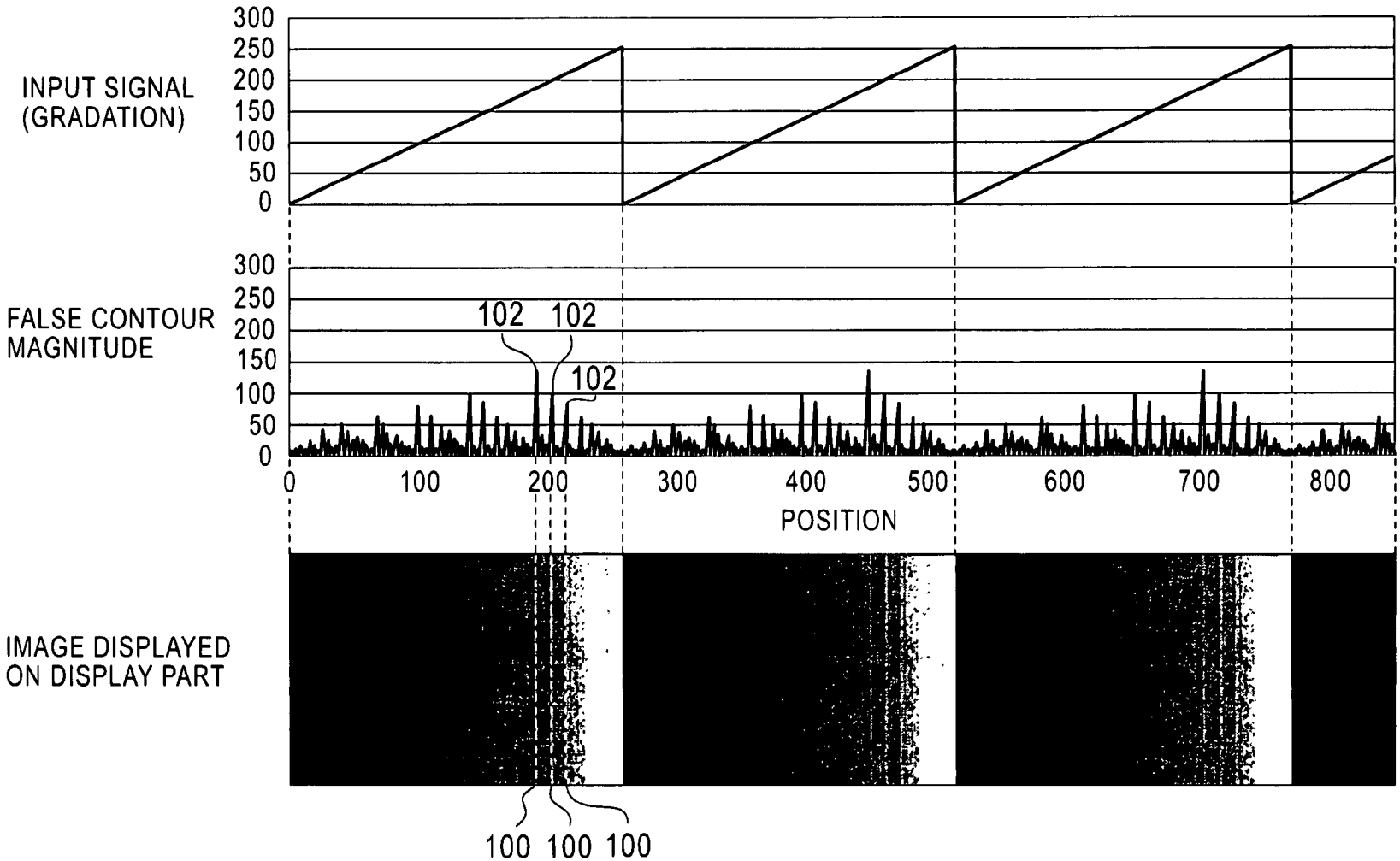
FIG. 7 is a diagram showing the relationship among an input signal (display data), false contour magnitude, and an image displayed on a display part in the first embodiment of the display device according to the present invention.

For example, when an input signal (display data) is directly input to the display part 2 without passing through the dynamic false contour reducing circuit 1 to display a moving image on the display part 2, the dynamic false contour 100 appears if a false contour magnitude $f_1$102 exhibited by the pixel Pi, j as the input signal (display data) is higher than other false contour magnitudes $f_1$, as shown in FIG. 7. In the display device 10 according to the first embodiment of the present invention, the dynamic false contour reducing circuit 1 generates a contour detection value for each of the determined subfields (first SF to m-th SF), calculates a viewed false contour magnitude $f_2$ in consideration of a false contour magnitude felt by the user when he actually views it, selects the candidate pixel signal having the smallest false contour magnitude $f_2$ from among the viewed false contour magnitudes $f_2$ exhibited respectively by the plurality of candidate pixel signals 8-1-8-*n*, and displays the selected candidate pixel signal on the display part 2 as the input signal (pixel of interest Pi,j), thus making it possible to more suitably reduce the dynamic false contour 100, as compared with the prior art which reduces a false contour by selecting a candidate pixel signal through a determination for evaluating a false contour magnitude $f_1$ which is simply found without taking into account a viewed false contour. In the display device 10 according to the first embodiment of the present invention, since the dynamic false contour is reduced, an image (moving image or still image) can be precisely displayed on the display part 2 in accordance with the input signal (display data).

The false contour magnitude generation part 13 of the false contour detector 3-*k* comprises a weighting part 14 and an adder 15.

The weighting part 14 multiplies a contour detection value by a gradation level corresponding to the first SF to m-th SF stored in the gradation level setting memory 7 for each of the determined subfields (first SF to m-th SF) to generate a false contour detection value. The adder 15 calculates the total value of the false contour detection values, each generated for each of the determined subfields (first SF to m-th SF), as a false contour magnitude $f_1$, and outputs an input signal (pixel Pi, j) having the false contour magnitude $f_1$ to a visual sensitivity conversion part 16 of the false contour detector 3-*k*.

As shown in FIG. 2, the dynamic false contour reducing circuit 1 further comprises a visual sensitivity setting memory 9. The false contour detector 3-*k* of the dynamic false contour reducing circuit 1 further comprises the visual sensitivity conversion part 16.

Figures 11, 12:
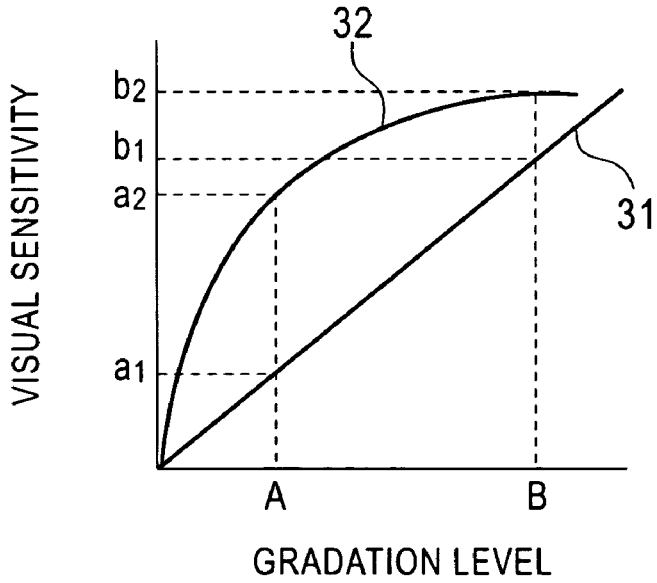
FIG. 11 is a diagram showing contents stored in a visual sensitivity setting memory within the dynamic false contour reducing circuit in the first embodiment of the display device according to the present invention.
FIG. 12 is a diagram for explaining the visual sensitivity in the first embodiment of the display device according to the present invention.

As shown in FIG. 11, the visual sensitivity setting memory 9 stores a gradation level of a pixel of interest, the false contour magnitude $f_1$, and the viewed spurious magnitude $f_2$ in correspondence to one another. The viewed false contour magnitude $f_2$ is a false contour magnitude felt by the user when he actually views the gradation level of the pixel of interest displayed on the display part 2.

The visual sensitivity conversion part 16 of the false contour detector 3-*k* searches for a viewed false contour magnitude $f_2$ corresponding to the gradation level of the pixel Pi,j, which is the pixel of interest, and a false contour magnitude $f_1$ with reference to the visual sensitivity setting memory 9, and outputs an input signal (pixel Pi,j) having the viewed false contour magnitude $f_2$ thus retrieved to the selector 4 as a candidate pixel signal 8-*k*.

When the gradation level of the input signal (pixel of interest) is displayed on the display part 2, the user views the gradation level. An ideal visual sensitivity felt by the user when he views the gradation level of the pixel of interest is represented by a function 31 shown in FIG. 12. The function 31 represents the relationship between the gradation level of the pixel of interest and the ideal visual sensitivity. The ideal visual sensitivity is proportional to the gradation level of the pixel of interest. When the gradation level of the pixel of interest is at A, the ideal visual sensitivity is represented by $a_1$, while when the gradation level of the pixel of interest is at B, the ideal visual sensitivity is represented by $b_1$. The gradation level B is higher than the gradation level A, while the ideal visual sensitivity $b_1$ is higher than the ideal visual sensitivity $a_1$.

However, according to the Weber-Fechner's law, a visual sensitivity felt by the user when he actually views a gradation level of a pixel of interest is represented by a function 32 shown in FIG. 12. The function 32 represents the relationship between the gradation level of the pixel of interest and the visual sensitivity felt by the user when he actually views the gradation level of the pixel of interest. The Weber-Fechner's law is described in "PDP Picture Quality Enhancement Based on Human Visual System Relevant Features," written by S. Weitbruch, R. Zwing, and C. Correa, IDW, pp. 699-702, Nov. 29, 2000. When the gradation level of the pixel of interest is at A, the visual sensitivity is represented by $a_2$. When the gradation level of the pixel of interest is at B, the visual sensitivity is represented by $b_2$. The visual sensitivity b2 is higher than the visual sensitivity $a_2$. Also, the visual sensitivity $a_2$ is significantly higher than the aforementioned ideal visual sensitivity $a_1$, while the visual sensitivity $b_2$ is slightly higher than the aforementioned ideal visual sensitivity $b_1$. In other words, with the gradation level of the pixel of interest being at A, when the user actually views the gradation level of the pixel of interest, the user feels the gradation level A much stronger than the ideal value (ideal visual sensitivity).

Figure 13:
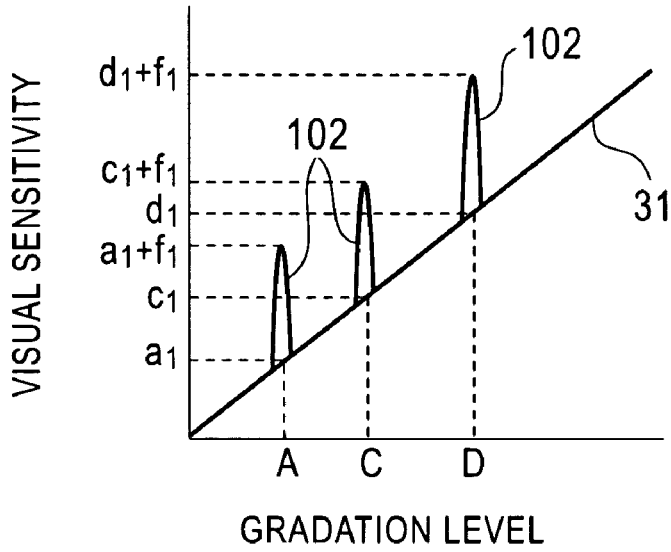
FIG. 13 is a diagram for explaining the visual sensitivity in the first embodiment of the display device according to the present invention.
Figure 14:
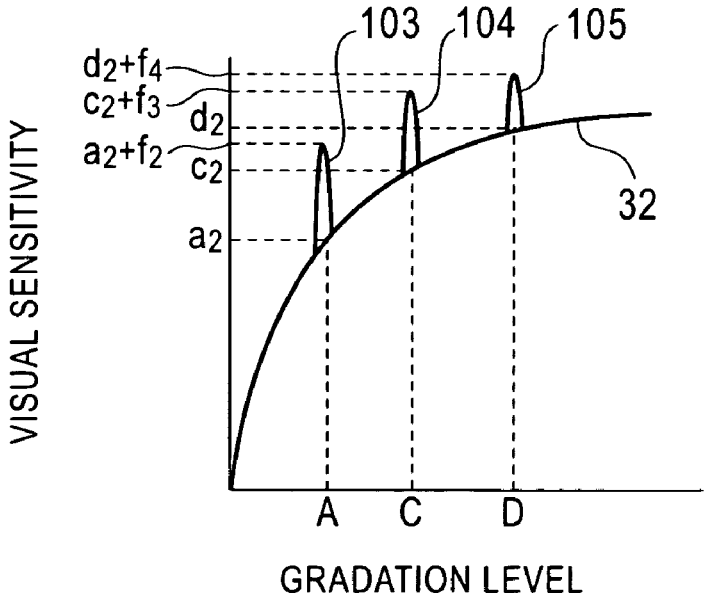
FIG. 14 is a diagram for explaining the visual sensitivity in the first embodiment of the display device according to the present invention.

As shown in FIG. 13, it is supposed that a visual sensitivity corresponding to the false contour magnitude $f_1$102 is superimposed on the function 31. For example, when pixels of interest have gradation levels A, C, D, ideal visual sensitivities are represented by a1, c1, d1, respectively, where A<C<D, and a1<c1<d1. When the pixel of interest has the false contour magnitude $f_1$102, the ideal visual sensitivities for the gradation levels A, C, D of the pixels of interest are represented by $a_1+f_1$, $c_1+f_1$, $d_1+f_1$, respectively, where $a_1+f_1<c_1+f_1<d_1+f_1$.

With the Weber-Fechner's law taken into account, when the pixels of interest have gradation levels A, C, D, the ideal visual sensitivities are represented by $a_2$, $c_2$, $d_2$, where $a_2<c_2<d_2$. When the pixel of interest has the false contour magnitude $f_1$102 with the Weber-Fechner's law taken into account, the visual sensitivities are represented by $a_2+f_2$, $c_2+f_3$, $d_2+f_4$ for the gradation levels A, C, D of the pixels of interest, respectively, where $a_2+f_2<c_2+f_3<d_2+f_4$. the visual sensitivity $f_2$ corresponds a viewed false contour magnitude $f_2$103 felt by the user when he actually views the gradation level A of the pixel of interest displayed on the display part 2. The visual sensitivity $f_3$ corresponds to a viewed false contour magnitude $f_2$104 felt by the user when he actually views the gradation level C of the pixel of interest displayed on the display part 2. The visual sensitivity $f_4$ corresponds to a viewed false contour magnitude $f_2$105 felt by the user when he actually views the gradation level D of the pixel of interest displayed on the display part 2.

In this way, even when an input signal (pixel of interest) has a false contour magnitude $f_1$, the viewed false contour magnitude $f_2$ differs depending on the gradation level of the pixel of interest. For this reason, in the display device 10 according to the first embodiment of the present invention, it is necessary to determine a viewed false contour magnitude $f_2$ corresponding to the gradation level of the pixel Pi,j, which is the pixel of interest, and the false contour magnitude $f_1$.

The operation of the display device 10 according to the first embodiment of the present invention will be described with reference to FIGS. 8, 9, 10, and 15.

Assume that the aforementioned value m is, for example, 11 (m=11). Assume also that the gradation level setting memory 7 stores, for example, gradation levels "1," "2," "14," "17," "11," "20," "30," "40," "45," "45," and "50" in correspondence to the first SF, second SF, third SF, fourth SF, fifth SF, sixth SF, seventh SF, eighth SF, ninth SF, tenth SF, and eleventh SF, respectively (see FIG. 8), Assume further that the pixel i−1,j has a gradation level "4," as a pixel (peripheral pixel) which adjoins the pixel Pi,j that is the pixel of interest, and that the first SF, second SF, third SF, fourth SF, fifth SF, sixth SF, seventh SF, eighth SF, ninth SF, tenth SF, and eleventh SF of the pixel Pi−1,j have gradation levels "0," "0," "4," "0," "0," "0," "0," "0," "0," "0," and "0" (see FIGS. 9 and 10). Assume that the pixel Pi,j has a gradation level "11."

The dynamic false contour reducing circuit 1 is applied with an input signal for displaying an image at the pixel Pi,j as display data. In response, the coding part 11 of the false contour detector 3 in the dynamic false contour reducing circuit 1 executes coding processing (step S1 in FIG. 15).

In the coding processing, the coding part 11 of the false contour detector 3-1 recognizes that the pixel Pi,j has the gradation level "11." The coding part 11 of the false contour detector 3-1 determines a plurality of determined subfields (first SF to eleventh SF) with reference to the gradation level setting memory 7. The total value of the gradation levels of the plurality of determined subfields (first SF to eleventh SF) represents the gradation level "11" of the pixel Pi,j. The first SF, second SF, third SF, fourth SF, fifth SF, sixth SF, seventh SF, eighth SF, ninth SF, tenth SF, and eleventh SF, which are determined subfields, have the gradation levels "0," "0," "4," "7," "0," "0," "0," "0," "0," "0," "0," respectively. The coding part 11 of the false contour detector 3-1 outputs the plurality of determined subfields (first SF to eleventh SF) as the first SF to eleventh SF of the input signal (pixel Pi,j) to the contour detection part 12 of the false contour detector 3-1.

Also, in the coding processing, the coding part 11 of the false contour detector 3-2 recognizes that the pixel Pi,j has a gradation level "11." the coding part 11 of the false contour detector 3-2 determines a plurality of determined subfields (first SF to eleventh SF) with reference to the gradation level setting memory 7. The total value of the gradation levels of the plurality of determined subfields (first SF to eleventh SF) represents the gradation level "11" of the pixel Pi,j. The first SF, second SF, third SF, fourth SF, fifth SF, sixth SF, seventh SF, eighth SF, ninth SF, tenth SF, and eleventh SF, which are determined subfields, have the gradation levels "0," "0," "0," "11," "0," "0," "0," "0," "0," "0," "0," respectively. The coding part 11 of the false contour detector 3-2 outputs the plurality of determined subfields (first SF to eleventh SF) as the first SF to eleventh SF of the input signal (pixel Pi,j) to the contour detection part 12 of the false contour detector 3-2.

Figure 15:
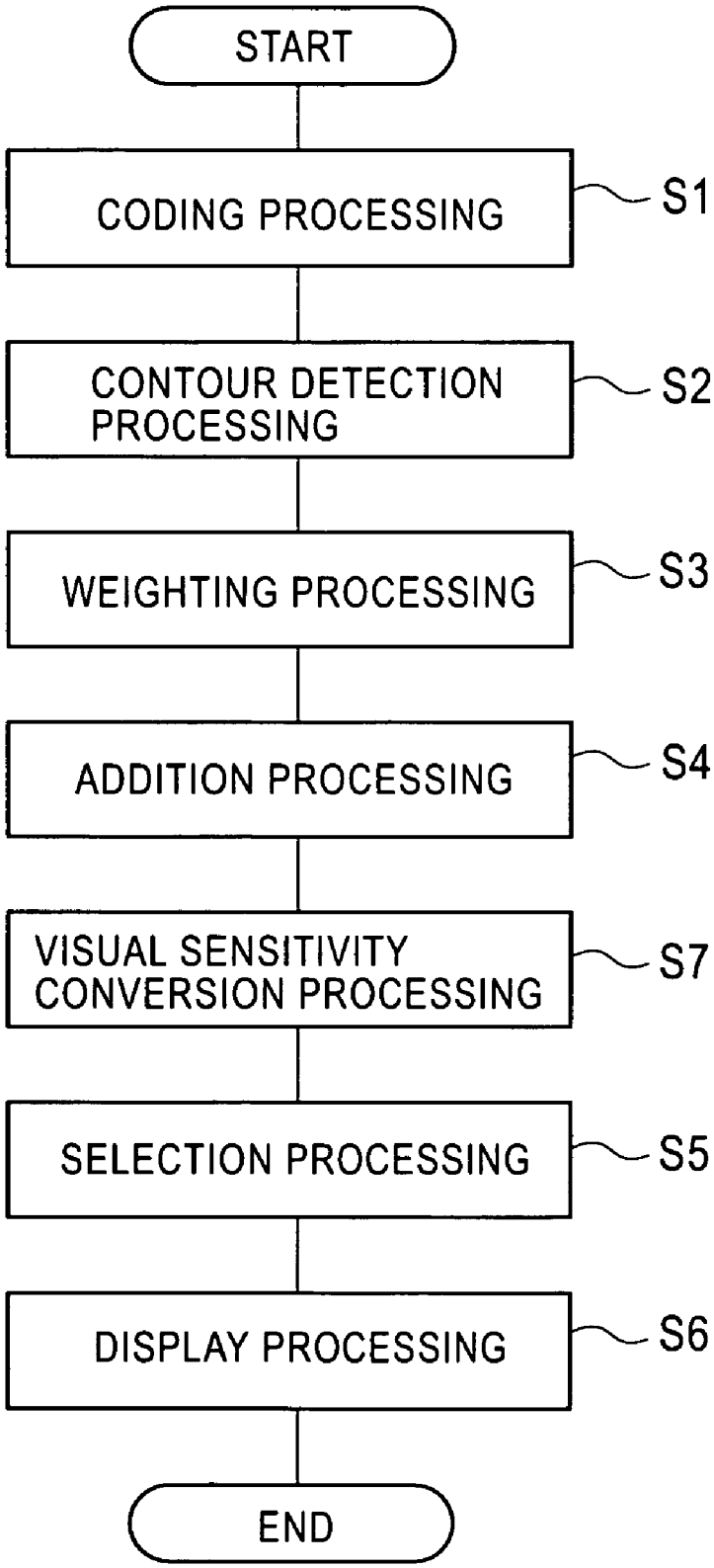
FIG. 15 is a flow chart showing the operation of the first embodiment of the display device according to the present invention.

Next, the contour detection part 12 of the false contour detector **3-*k* in the dynamic false contour reducing circuit 1 executes contour detection processing (step S2 in FIG. 15**).

In the contour detection processing, the contour detector 12 of the false contour detector 3-1 examines the presence or absence of a difference in level between the pixel i,j represented by the input signal from the coding part 11 of the false contour detector 3-1 and the pixel which adjoins the pixel Pi,j for each of the determined subfields (first SF to eleventh SF) with reference to the reference memory 6. As shown in FIG. 9, a difference in level is produced between the fourth SF of the pixel Pi,j and the fourth SF of the pixel Pi−1,j which adjoins the pixel Pi,j. The contour detection part 12 of the false contour detector 3-1 generates a contour detection value "1" indicating that there is a difference in level between the pixel Pi,j and pixel Pi−1,j in the fourth SF. On the other hand, there is no difference in level between the first SF to third SF and fifth SF to eleventh SF of the pixel Pi,j and the first SF to third SF and fifth SF to eleventh SF of the pixel Pi−1,j. The contour detection part 12 of the false contour detector 3-1 generates a contour detection value "0" which indicates that there is no difference in level between the pixel Pi,j and pixel Pi−1,j in the first SF to third SF and fifth SF to eleventh SF. The contour detection part 12 of the false contour detector 3-1 outputs an input signal (pixel i,j) having contour detection values "0," "0," "0," "1," "0," "0," "0," "0," "0," "0," "0" for the first SF, second SF, third SF, fourth SF, fifth SF, sixth SF, seventh SF, eighth SF, ninth SF, tenth SF, and eleventh SF to the weighting part 4 of the false contour detector 3-1.

Also, in the contour detection processing, the contour detection part 12 of the false contour detector 3-2 examines the presence or absence of a difference in level between the pixel Pi,j represented by the input signal from the coding part 11 of the false contour detector 3-2 and a pixel which adjoins the pixel Pi,j for each of the determined subfields (first SF to eleventh SF) with reference to the reference memory 6. As shown in FIG. 10, there are differences in level generated between the third SF and fifth SF of the pixel Pi,j and the third SF and fifth SF of the pixel Pi−1,j which adjoins the pixel Pi,j. The contour detection part 12 of the false contour detector 3-2 generates a contour detection value "1" which indicates that there are differences in level between the pixel Pi,j and pixel Pi−1,j in the third SF and fifth SF. On the other hand, there is no difference in level produced between the first SF, second SF, fourth SF, and sixth SF to eleventh SF of the pixel Pi,j and the first SF, second SF, fourth SF, and sixth SF to eleventh SF of the pixel Pi−1,j. The contour detection part 12 of the false contour detector 3-2 generates a contour detection value "0" which indicates that there is no difference in level between the pixel Pi,j and pixel Pi−1,j in the first SF, second SF, fourth SF, and sixth SF to eleventh SF. The contour detection part 12 of the false contour detector 3-2 outputs an input signal (pixel Pi,j) having the contour detection values "0," "0," "1," "0," "1," "0," "0," "0," "0," "0," "0" for the first SF, second SF, third SF, fourth SF, fifth SF, sixth SF, seventh SF, eighth SF, ninth SF, tenth SF, and eleventh SF to the weighting part 14 of the false contour detector 3-2.

Next, the weighting part 14 of the false contour detector **3-*k* in the dynamic false contour reducing circuit 1 executes weighting processing (step S3 in FIG. 15**).

In the weighting processing, the weighting part 14 of the false contour detector 3-1 multiplies the contour detection values "0," "0," "0," "1," "0," "0," "0," "0," "0," "0," "0" for the first SF, second SF, third SF, fourth SF, fifth SF, sixth SF, seventh SF, eighth SF, ninth SF, tenth SF, and eleventh SF of the input signal (pixel Pi,j) from the contour detection part 12 of the false contour detector 3-1 by the gradation levels "1," "2," "4," "7," "11," "20," "30," "40," "45," "45," and "50" as weighting coefficients, with reference to the gradation level setting memory 7, to generate false contour detection values "0," "0," "0," "7," "0," "0," "0," "0," "0," "0," and "0" (see FIG. 9). The weighting part 14 of the false contour detector 3-1 outputs an input signal (pixel i,j) having false contour detection values "0," "0," "0," "7," "0," "0," "0," "0," "0," "0," "0," for the first SF, second SF, third SF, fourth SF, fifth SF, sixth SF, seventh SF, eighth SF, ninth SF, tenth SF, and eleventh SF to the adder 15 of the false contour detector 3-1.

Also, in the weighting processing, the weighting part 14 of the false contour detector 3-2 multiplies the contour detection values "0," "0," "1," "0," "1," "0," "0," "0," "0," "0," "0" for the first SF, second SF, third SF, fourth SF, fifth SF, sixth SF, seventh SF, eighth SF, ninth SF, tenth SF, and eleventh SF of the input signal (pixel Pi,j) from the contour detection part 12 of the false contour detector 3-2 by the gradation levels "1," "2," "4" "7," "11," "20," "30," "40," "45," "45," "50" as weighting coefficients, with reference to the gradation level setting memory 7, to generate false contour detection values "0," "0," "4," "0," "11," "0," "0," "0," "0," "0," "0," "0," (see FIG. 10). The weighting part 14 of the false contour detection part 3-2 outputs an input signal (pixel Pi,j) having the false contour detection values "0," "0," "4," "0," "11," "0," "0," "0," "0," "0," "0," "0," for the first SF, second SF, third SF, fourth SF, fifth SF, sixth SF, seventh SF, eighth SF, ninth SF, tenth SF, and eleventh SF to the adder 15 of the false contour detector 3-2.

Next, the adder 15 of the false contour detector **3-*k* in the dynamic false contour reducing circuit 1 performs addition processing (step S4 in FIG. 15**).

In the addition processing, the adder 15 of the false contour detector 3-1 calculates the total value of the false contour detection values "0," "0," "0," "7," "0," "0," "0," "0," "0," "0," "0," for the first SF, second SF, third SF, fourth SF, fifth SF, sixth SF, seventh SF, eighth SF, ninth SF, tenth SF, and eleventh SF of the input signal (pixel Pi,j) from the weighting part 14 of the false contour detector 3-1, and generates a false contour magnitude $f_1$ "7" indicative of the total value. The adder 15 of the false contour detector 3-1 outputs an input signal (pixel Pi,j) having the false contour magnitude $f_1$ "7" to the visual sensitivity conversion part 16 of the false contour detector 3-1.

Also, in the addition processing, the adder 15 of the false contour detector 3-2 calculates the total value of false contour detection values "0," "0," "4," "0," "11," "0," "0," "0," "0," "0," "0," "0," for the first SF, second SF, third SF, fourth SF, fifth SF, sixth SF, seventh SF, eighth SF, ninth SF, tenth SF, and eleventh SF of the input signal (pixel i,j) from the weighting part 14 of the false contour detector 3-2 to generate a false contour magnitude $f_1$ "15" indicative of the total value. The adder 15 of the false contour detector 3-1 output an input signal (pixel Pi,j) having the false contour magnitude $f_1$ "15" to the visual sensitivity conversion part 16 of the false contour detector 3-2.

Next, the visual sensitivity conversion part 16 of the false contour detector **3-*k* in the dynamic false contour reducing circuit 1 executes visual sensitivity conversion processing (step S7 in FIG. 15**).

In the visual sensitivity conversion processing, the visual sensitivity conversion part 16 of the false contour detector 3-1 searches for a viewed false contour magnitude $f_2$ corresponding to the gradation level of the pixel Pi,j and the false contour magnitude $f_1$ "7" with reference to the visual sensitivity setting memory 9, and outputs an input signal (pixel Pi,j) having the viewed false contour magnitude $f_2$ thus retrieved to the selector 4 as a candidate pixel signal 8-1.

Also, in the visual sensitivity conversion processing, the visual sensitivity conversion part 16 of the false contour detector 3-2 searches for a viewed false contour magnitude $f_2$ corresponding to the gradation level of the pixel Pi,j and the false contour magnitude $f_1$ "15" with reference to the visual sensitivity setting memory 9, and outputs an input signal (pixel Pi,j) having the viewed false contour magnitude $f_2$ thus retrieved to the selector 4 as a candidate pixel signal 8-2.

Next, the selector 4 of the dynamic false contour reducing circuit 1 executes selection processing (step 5 in FIG. 15).

In the selection processing, the selection part 4 selects the candidate pixel signal 8-1 having the smallest false contour magnitude $f_2$ from the false contour magnitudes $f_2$ included in the candidate pixel signals 8-1, 8-2. The selector 4 outputs the candidate pixel signal 8-1 to the display controller 5, and stores the candidate pixel signal 8-1 in the reference memory 6 as an input signal for displaying an image at a peripheral pixel (pixel Pi,j).

Next, the display control part 5 of the dynamic false contour reducing circuit 1 executes display processing (step S6 in FIG. 15).

In the display processing, the display controller 5 controls the display part 2 such that the candidate pixel signal 8-1 selected by the selector 4 is applied thereto to display the candidate pixel signal 8-1 representative of the gradation level "11" as an input signal (pixel Pi,j).

As can be understood from the foregoing description, when the user actually views the gradation level at the pixel of interest on the display part 2, the user may feel the gradation level stronger than it actually is, but in the display device 10 according to the first embodiment of the present invention, the dynamic false contour reducing circuit 1 generates a contour detection value for each of the determined subfields (first SF to eleventh SF), determines a viewed false contour magnitude $f_2$ corresponding to the gradation level of a pixel of interest Pi,j and the false contour magnitude $f_1$, selects the candidate pixel signal 8-1 having the smallest false contour magnitude $f_2$ from the false contour magnitudes $f_2$ included in each of a plurality of candidate pixel signals 8-1 to 8-11, and displays the selected candidate pixel signal 8-1 on the display part 2 as an input signal (pixel of interest Pi,j). Thus, the display device 10 according to the first embodiment of the present invention can more precisely reduce the dynamic false contour 100 than the prior art.

The display device 10 according to the first embodiment of the present invention can precisely display an image (moving image or still image) in accordance with an input signal (display data) on the display part 2 because the dynamic false contour 100 is reduced.

In the display device 10 according to the first embodiment of the present invention, input signals each for displaying an image at a pixel Pi,j are sequentially applied to the dynamic false contour reducing circuit 1 as display data, however, the present invention is not limited to this manner of applying input signals. The dynamic false contour reducing circuit 1 can receive an input signal for displaying an image at each pixel as display data, store the input signals in the reference memory 6, and execute the aforementioned coding processing (step S1), contour detection processing (step S2), weighting processing (step S3), addition processing (step S4), selection processing (step S5), visual sensitivity conversion processing (step S7), and display processing (step S6) for 3×3 pixels. In this event, when a pixel of interest is chosen to be a pixel Pi,j, peripheral pixels include pixels Pi−1,j−1, Pi,j−1, Pi−1,j−1, Pi−1,j, Pi+1,j, Pi−1,j+1, Pi,j+1, and Pi−1,j+1.

Second Embodiment

The gradation level (weight) of each of the plurality of subfields (first SF to m-th SF) are gradually higher in the order of the first SF to m-th SF. Therefore, when m is chosen to be 11 as in the first embodiment, the dynamic false contour 100 can appear more intense due to a difference in level between a pixel of interest Pi,j and peripheral pixels Pi−1,j in the sixth SF to eleventh SF. A dynamic false contour reducing method according to a second embodiment of the present invention reduces the dynamic false contour 100 more precisely than the first embodiment by previously defining a subfield group, which has been set to a gradation level indicative of lit state (other than black), for the gradation level of an input signal (pixel Pi,j). The dynamic false contour reducing method according to the second embodiment of the present invention will be described.

Figure 16:
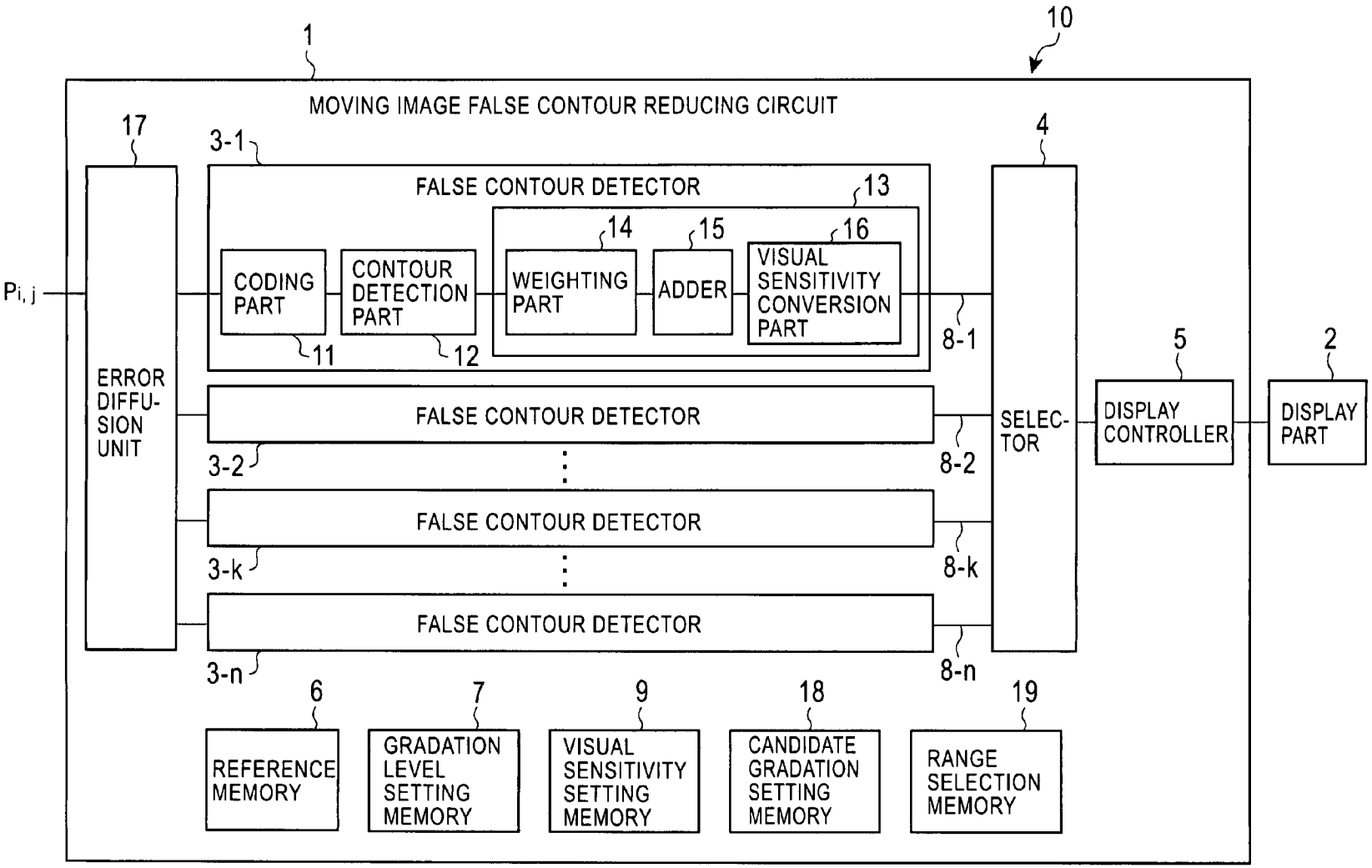
FIG. 16 is a block diagram showing the configuration of a second embodiment of the display device according to the present invention.

The dynamic false contour reducing method according to the present invention is implemented by a display device 10 as shown in FIG. 16. FIG. 16 is a block diagram showing the configuration of the display device 10 according to the second embodiment. In the second embodiment, components identical to those in the first embodiment are designated the same reference numerals. A dynamic false contour reducing circuit 1 of the display device 10 according to the second embodiment of the present invention further comprises a candidate gradation setting memory 18, and a range selection memory 19. The dynamic false contour reducing circuit 1 further comprises an error diffusion part 17. The error diffusion part 17 receives an input signal for displaying an image at a pixel of interest Pi,j, and outputs an input signal (pixel of interest Pi,j) including a candidate subfield group, later described, to a plurality of false contour detectors 3-1 to **3-*n***.

Figure 17:
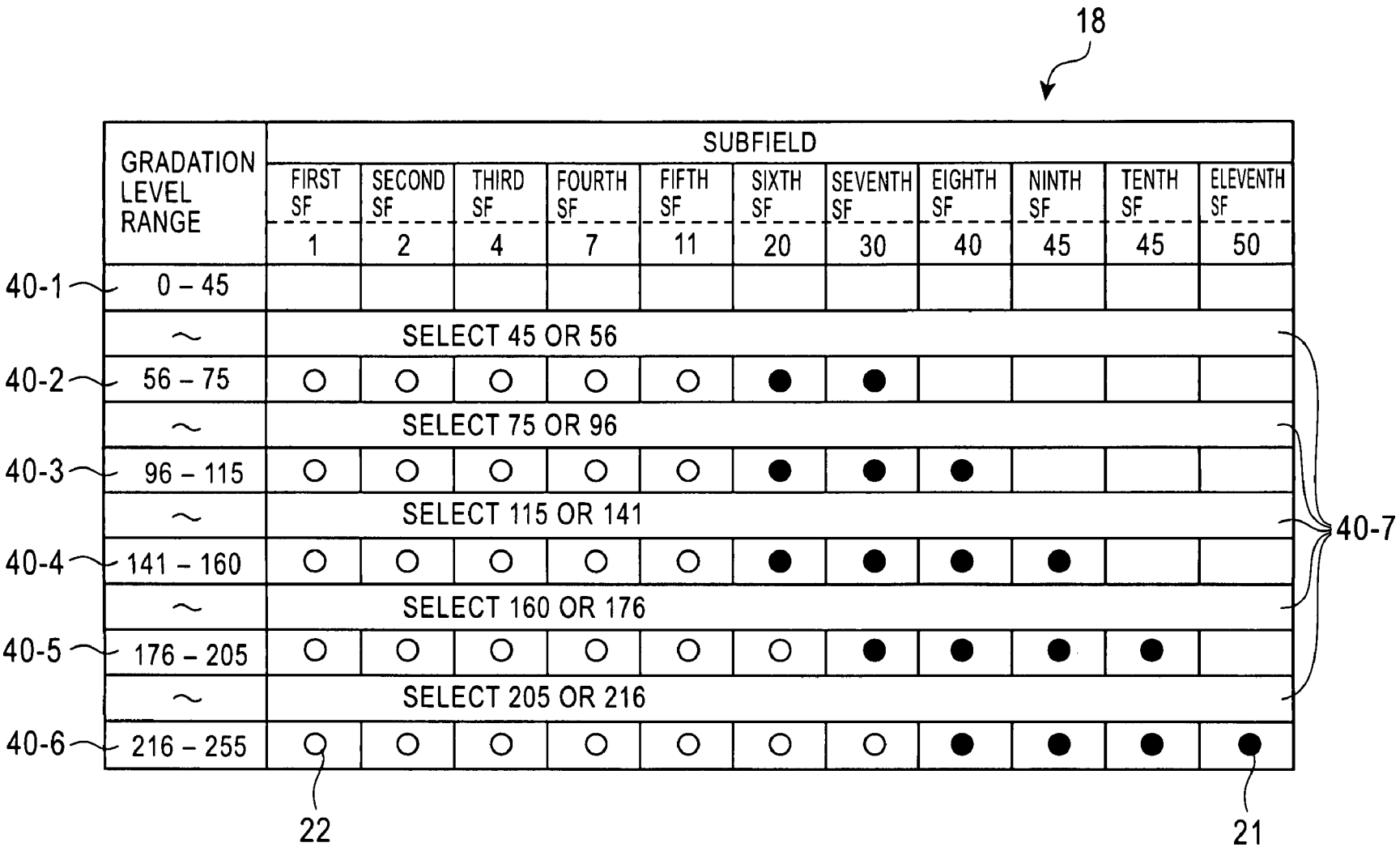
FIG. 17 is a diagram showing contents stored in a candidate gradation setting memory within a dynamic false contour reducing circuit in the second embodiment of the display device according to the present invention.

As shown in FIG. 17, the candidate gradation setting memory 18 stores a plurality of gradation level ranges 40-1 to 40-7, and a plurality of subfields (first SF to m-th SF) in correspondence to each other. Like the first embodiment, the above-mentioned m is assumed to be 11 (m=11). The first SF, second SF, third SF, fourth SF, fifth SF, sixth SF, seventh SF, eighth SF, ninth SF, tenth SF, and eleventh SF stored in the candidate gradation setting memory 18 represent gradation levels "1," "2," "14," "7," "11," "20," "30," "40," "45," "45," and "50."

In the plurality of gradation level ranges 40-1 to 40-7, the gradation level range 40-1 represents the range of gradation levels "0 to 45"." When the gradation level of an input signal (pixel Pi,j) is included in the gradation level range 40-1, the gradation level is relatively low, so that it is not necessary to previously determine a subfield group (first determined subfield group 21) which has been set to a gradation level representative of lit state (other than black). In other words, the first determined subfield group 21 corresponding to the gradation level range 40-1 need not be set in the candidate gradation setting memory 18. In this event, the error diffusion part 17 outputs an input signal (pixel of interest Pi,j) to a plurality of false contour detectors 3-1 to **3-*n* with reference to the candidate gradation setting memory 18. The coding part 11 of the false contour detector 3-*k*** determines a plurality of the aforementioned determined subfields (first SF to eleventh SF) in a manner similar to the first embodiment.

In the plurality of gradation level ranges 40-1 to 40-7, the gradation level range 40-2 represents the range of gradation levels "56-75." When the gradation level of an input signal (pixel Pi,j) is included in the gradation level range 40-2, the sixth SF and seventh SF are previously determined as a subfield group which has been set to a gradation level representative of lit state (other than black). Specifically, the sixth SF and seventh SF are set in the candidate gradation setting memory 18 as a first determined subfield group 21 corresponding to the gradation level range 40-2. In this event, the error diffusion part 17 determines a candidate subfield group (first SF to seventh SF) corresponding to the gradation level range 40-2 in a plurality of subfields (first SF to eleventh SF) with reference to the candidate gradation setting memory 18, and outputs an input signal (pixel of interest Pi,j) including the candidate subfield group (first SF to seventh SF) to the plurality of false contour detectors 3-1 to **3-*n*. The candidate subfield group (first SF to seventh SF) includes the first determined subfield group 21 (sixth SF, seventh SF) and the first SF to fifth SF which make up a selected candidate subfield group 22. The coding part 11 of the false contour detector 3-*k*** determines a plurality of determined subfields (first SF to eleventh SF) mentioned above with this candidate subfield group (first SF to seventh SF).

In the plurality of gradation level ranges 40-1 to 40-7, the gradation level range 40-3 represents the range of gradation levels "96-115." When the gradation level of an input signal (pixel Pi,j) is included in the gradation level range 40-3, the sixth SF to eighth SF are previously determined as the first determined subfield group 21. Specifically, the sixth SF to eighth SF are set in the candidate gradation setting memory 18 as the first determined subfield group 21 corresponding to the gradation level range 40-3. In this event, the error diffusion part 17 determines a candidate subfield group (first SF to eighth SF) corresponding to the gradation level range 40-3 in the plurality of subfields (first SF to eleventh SF) with reference to the candidate gradation setting memory 18, and outputs an input signal (pixel of interest Pi,j) including the candidate subfield group (first SF to eighth SF). This candidate subfield group (first SF to eighth SF) includes the first determined subfield group 21 (sixth SF to eighth SF), and the first SF to fifth SF which make up the selected candidate subfield group 22. The coding part 11 of the false contour detector **3-*k*** determines the plurality of determined subfields (first SF to eleventh SF) with this candidate subfield group (first SF to eighth SF).

In the plurality of gradation level ranges 40-1 to 40-7, the gradation level range 40-4 represents the range of gradation levels "141-160." When the gradation level of an input signal (pixel Pi,j) is included in the gradation level range 40-4, the sixth SF to ninth SF are previously determined as the first determined subfield group 21. Specifically, the sixth SF to ninth SF are set in the candidate gradation setting memory 18 as the first determined subfield group 21 corresponding to the gradation level range 40-4. In this event, the error diffusion part 17 determines a candidate subfield group (first SF to ninth SF) corresponding to the gradation level range 40-4 in the plurality of subfields (first SF to eleventh SF) with reference to the candidate gradation setting memory 18, and outputs an input signal (pixel of interest Pi,j) including the candidate subfield group (first SF to ninth SF) to the plurality of false contour detectors 3-1 to **3-*n*. This candidate subfield group (first SF to ninth SF) includes the first determined subfield group 21 (sixth SF to ninth SF) and the first SF to fifth SF which make up the selected candidate subfield group 22. The coding part 11 of the false contour detector 3-*k*** determines the plurality of determined subfields (first SF to eleventh SF) with this candidate subfield group (first SF to ninth SF).

In the plurality of gradation level ranges 40-1 to 40-7, the gradation level range 40-5 represents the range of gradation levels "176-205." When the gradation level of an input signal (pixel Pi,j) is included in the gradation level range 40-5, the seventh SF to tenth SF are previously determined as the first determined subfield group 21. Specifically, the seventh SF to tenth SF are set in the candidate gradation setting memory 18 as the first determined subfield group 21 corresponding to the gradation level range 40-5. In this event, the error diffusion part 17 determines a candidate subfield group (first SF to tenth SF) corresponding to the gradation level range 40-5 in the plurality of subfields (first SF to eleventh SF) with reference to the candidate gradation setting memory 18, and outputs an input signal (pixel of interest Pi,j) including the candidate subfield group (first SF to tenth SF) to the plurality of false contour detectors 3-1 to **3-*n*. This candidate subfield group (first SF to tenth SF) includes the first determined subfield group 21 (seventh SF to tenth SF) and the first SF to sixth SF which make up the selected candidate subfield group 22. The coding part 11 of the false contour detector 3-*k*** determines the plurality of determined subfields (first SF to eleventh SF) with this candidate subfield group (first SF to tenth SF).

In the plurality of gradation level ranges 40-1 to 40-7, the gradation level range 40-6 represents the range of gradation levels "216-255." When the gradation level of an input signal (pixel Pi,j) is included in the gradation level range 40-6, the eighth SF to eleventh SF are previously determined as the first determined subfield group 21. Specifically, the eighth SF to eleventh SF are set in the candidate gradation setting memory 18 as the first determined subfield group 21 corresponding to the gradation level range 40-6. In this event, the error diffusion part 17 determines a candidate subfield group (first SF to eleventh SF) corresponding to the gradation level range 40-6 in the plurality of subfields (first SF to eleventh SF) with reference to the candidate gradation setting memory 18, and outputs an input signal (pixel of interest Pi,j) including the candidate subfield group (first SF to eleventh SF) to the plurality of false contour detectors 3-1 to **3-*n*. This candidate subfield group (first SF to eleventh SF) includes the first determined subfield group 21 (eighth SF to tenth SF) and the first SF to seventh SF which make up the selected candidate subfield group 22. The coding part 11 of the false contour detector 3-*k*** determines the plurality of determined subfields (first SF to eleventh SF) with this candidate subfield group (first SF to eleventh SF).

In the plurality of gradation level ranges 40-1 to 40-7, the gradation level range 40-7 represents a range out of the gradation level ranges 40-1 to 40-6.

As shown in FIG. 18, the range selection memory 19 stores the first gradation level range, second gradation level range, and selection information for selecting one of the first gradation level range and second gradation level range in correspondence to one another. A gradation level range **40-*q* (q=1, 2, 3, 4, 5) as the first gradation level range represents a flag "0," and a gradation level range 40-(*q*+1)** represents a flag "1." The selection information indicates the flag "0" or "1."

For example, the error diffusion part 17 references the candidate gradation setting memory 18, and further references the range selection memory 19 when the gradation level of an input signal (pixel Pi,j) is included in the gradation level range 40-7 between the gradation level range 40-5 and gradation level range 40-6.

When the flag represented by the selection information corresponding to the first gradation level range (gradation level range 40-5) and second gradation level range (gradation level range 40-6) is "0," the error diffusion part 17 regards the gradation level of the input signal (pixel of interest Pi,j) as a spurious gradation level, and sets it at a gradation level "205" which is an upper limit value of the gradation levels "176-205" represented by the gradation level range 40-5, and selects the gradation level range 40-5. Upon selection of the gradation level range 40-5, the error diffusion part 17 determines a candidate subfield group (first SF to tenth SF) corresponding to the gradation level range 40-5 in the plurality of subfields (first SF to tenth SF). In this event, the error diffusion part 17 outputs an input signal (pixel of interest Pi,j) including the candidate subfield group (first SF to tenth SF) to the plurality of false contour detectors 3-1 to **3-*n*. The gradation level of the input signal (pixel of interest Pi,j) output from the error diffusion part 17** represents 205.

When the flag represented by the selection information corresponding to the first gradation level range (gradation level range 40-5) and second gradation level range (gradation level range 40-6) is "1," the error diffusion part 17 regards the gradation level of the input signal (pixel of interest Pi,j) as a spurious gradation level, and sets it at a gradation level "216" which is a lower limit value of the gradation levels "216-225" represented by the gradation level range 40-6, and selects the gradation level range 40-6. Upon selection of the gradation level range 40-6, the error diffusion part 17 determines a candidate subfield group (first SF to eleventh SF) corresponding to the gradation level range 40-6 in the plurality of subfields (first SF to eleventh SF). In this event, the error diffusion part 17 outputs an input signal (pixel of interest Pi,j) including the candidate subfield group (first SF to tenth SF) to the plurality of false contour detectors 3-1 to **3-*n*. The gradation level of the input signal (pixel of interest Pi,j) output from the error diffusion part 17** represents 216.

The operation of the display device 10 according to the second embodiment of the present invention will be described with reference to FIGS. 8, 16, and 24.

Like the first embodiment, assume that the gradation level setting memory 7 stores gradation levels "1," "2," "4," "7," "11," "20," "30," "40," "45," "45," and "50" corresponding to the first SF, second SF, third SF, fourth SF, fifth SF, sixth SF, seventh SF, eighth SF, ninth SF, tenth SF, and eleventh SF (see FIG. 8).

Cases (A), (B-1), and (B-2) are given as examples for describing the operation of the display device 10 according to the second embodiment of the present invention.

In Case (A), the gradation level of an input signal (pixel of interest Pi,j) is included in the gradation level range 40-2, and the error diffusion part 17 outputs an input signal (pixel of interest Pi,j) including a candidate subfield group (first SF to seventh SF) to the plurality of false contour detectors 3-1 to **3-*n***.

In Case (B-1), the gradation level of an input signal (pixel of interest Pi,j) is included in the gradation level range 40-7 between the gradation level range 40-5 and gradation level range 40-6. The error diffusion part 17 selects the gradation level range 40-5 from among the gradation level range 40-5 and gradation level range 40-6, and outputs an input signal (pixel of interest Pi,j) including a candidate subfield group (first SF to tenth SF) to the plurality of false contour detectors 3-1 to **3-*n***.

In Case (B-2), the gradation level of an input signal (pixel Pi,j) is included in the gradation level range 40-7 between the gradation level range 40-5 and gradation level range 40-6. The error diffusion part 17 selects the gradation level range 40-6 from among the gradation level range 40-5 and gradation level range 40-6, and outputs an input signal (pixel of interest Pi,j) including a candidate subfield group (first SF to eleventh SF) to the plurality of false contour detectors 3-1 to **3-*n***.

The aforementioned Case (A) will be described. Assume that the gradation level of a pixel Pi−1,j is 56 as a pixel (peripheral pixel) adjacent to the pixel Pi,j, which is the pixel of interest, and the gradation levels of the first SF, second SF, third SF, fourth SF, fifth SF, sixth SF, seventh SF, eighth SF, ninth SF, tenth SF, and eleventh SF of the pixel Pi−1,j are "0," "2," "4," "0," "0," "20," "30," "0," "0," "0," and "0" (see FIGS. 20 and 21). Assume also that the gradation level of the pixel Pi,j is 57.

The dynamic false contour reducing circuit 1 is applied with an input signal for displaying an image at the pixel Pi,j as display data. In this event, the error diffusion part 17 of the dynamic false contour reducing circuit 1 executes error diffusion processing (step S8 in FIG. 19).

In the error diffusion processing, the error diffusion part 17 recognizes that the gradation level of the pixel Pi,j is 57. The error diffusion part 17 selects the gradation level range 40-2 which includes the gradation level of the input signal (pixel of interest Pi,j) from among the plurality of gradation level ranges 40-1 to 40-7 with reference to the candidate gradation setting memory 18. The error diffusion part 17 determines a candidate subfield group (first SF to seventh SF) corresponding to the gradation level range 40-2 in the plurality of subfields (first SF to eleventh. SF) with reference to the candidate gradation setting memory 18, and outputs an input signal (pixel of interest Pi,j) including the candidate subfield group (first SF to seventh SF) to the plurality of false contour detectors 3-1 to **3-*n*. This candidate subfield group (first SF to seventh SF) includes the first determined subfield group 21 (sixth SF and seventh SF) and the first SF to fifth SF which make up the selected candidate subfield group 22**.

Figure 19:
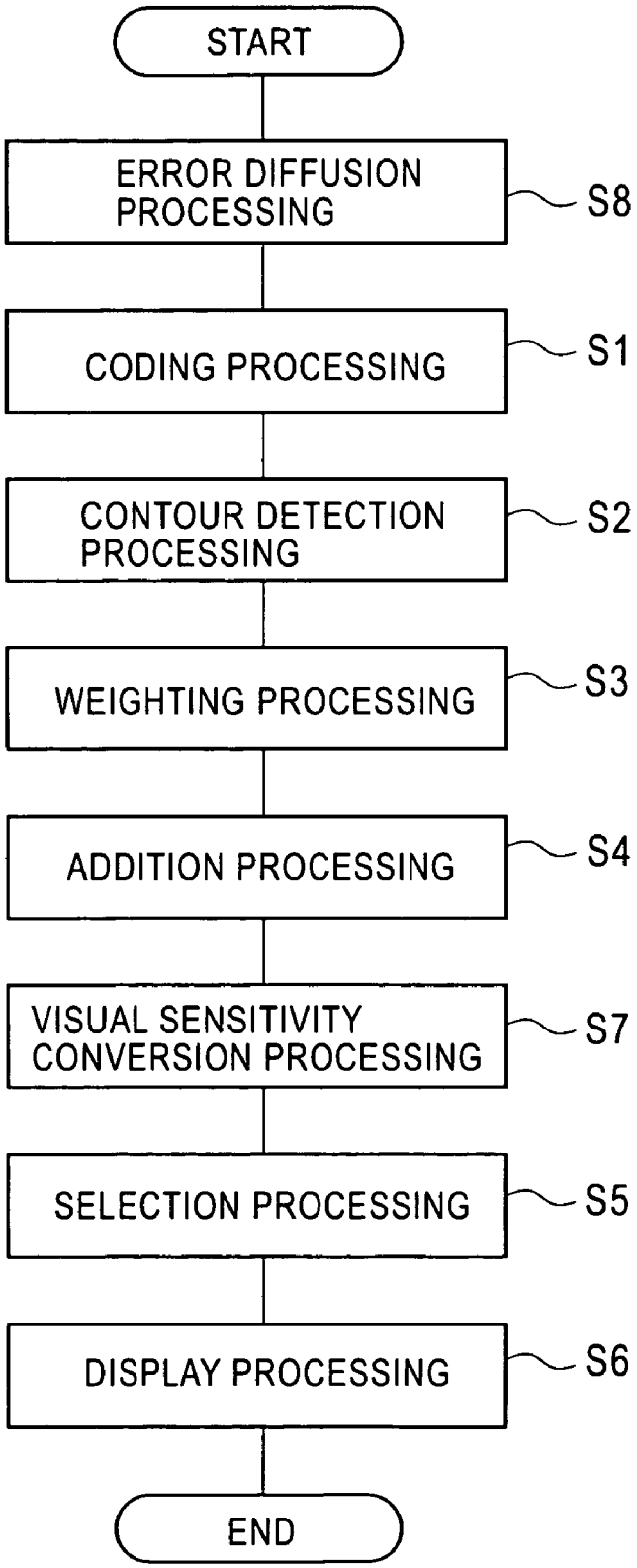
FIG. 19 is a flow chart showing the operation of the second embodiment of the display device according to the present invention.

Next, the coding part 11 of the false contour detector **3-*k* in the dynamic false contour reducing circuit 1 executes coding processing (step S1 in FIG. 19**).

In the coding processing, the coding part 11 of the false contour detector 3-1 recognizes that the gradation level of the pixel Pi,j is 57. The coding part 11 of the false contour detector 3-1 determines a plurality of determined subfields (first SF to eleventh SF) with reference to the gradation level setting memory 7. The plurality of determined subfields (first SF to eleventh SF) includes the first determined subfield group (sixth SF and seventh SF), and a second determined subfield group (first SF to third SF) of the second candidate subfield group 22 (first SF to fifth SF) (see FIG. 19). The total value of the gradation levels of the first determined subfield group 21 (sixth SF and seventh SF) and the second determined subfield group (first SF to third SF) represents the gradation level of the pixel Pi,j. Specifically, the gradation levels of the first SF, second SF, third SF, fourth SF, fifth SF, sixth SF, seventh SF, eighth SF, ninth SF, tenth SF, and eleventh SF, which belong to the determined subfields, are "1," "2," "4," "0," "0," "20," "30," "0," "0," "0," and "0," respectively. The coding part 11 of the false contour detector 3-1 outputs the plurality of determined subfields (first SF to eleventh SF) to the contour detector 12 of the false contour detector 3-1 as the first SF to eleventh SF of the input signal (pixel Pi,j).

Also, in the coding processing, the coding part 11 of the false contour detector 3-2 recognizes that the gradation level of the pixel Pi,j is 57. The coding part 11 of the false contour detector 3-2 determines a plurality of determined subfields (first SF to eleventh SF) with reference to the gradation level setting memory 7. The plurality of determined subfields (first SF to eleventh SF) includes the first determined subfield group 21 (sixth SF and seventh SF) and a second determined subfield group (fourth SF) in the selected candidate subfield group 22 (first SF to fifth SF) (see FIG. 21). The total value of the gradation levels of the first determined subfield group 21 (sixth SF and seventh SF) and second determined subfield group (fourth SF) represents the gradation level of the pixel Pi,j. Specifically, the first SF, second SF, third SF, fourth SF, fifth SF, sixth SF, seventh SF, eighth SF, ninth SF, tenth SF, and eleventh SF, which belong to the determined subfields, are "0," "0," "0," "7," "0," "20," "30," "0," "0," "0," and "0." the coding part 11 of the false contour detector 3-2 outputs the plurality of determined subfields (first SF to eleventh SF) to the contour detection part 12 of the false contour detector 3-2 as the first SF to eleventh SF of the input signal (pixel Pi,j).

Next, the contour detection part 12 of the false contour detector **3-*k* in the dynamic false contour reducing circuit 1 executes the contour detection processing in a manner similar to the first embodiment (step S2 in FIG. 19**).

In the contour detection processing, the contour detection part 12 of the false contour detector 3-1 examines the presence or absence of a difference in level between the pixel Pi,j represented by the input signal from the coding part 11 of the false contour detector 3-1 and a pixel (pixel Pi−1,j) adjacent to the pixel Pi,j for each of the determined subfields (first SF to eleventh SF) with reference to the reference memory 6. The contour detection part 12 of the false contour detector 3-1 outputs an input signal (pixel Pi,j) having contour detection values "1," "0," "0," "0," "0," "0," "0," "0," "0," "0," and "0" for the first SF, second SF, third SF, fourth SF, fifth SF, sixth SF, seventh SF, eighth SF, ninth SF, tenth SF, and eleventh SF to the weighting part 14 of the false contour detector 3-1.

In the contour detection processing, the contour detection part 12 of the false contour detector 3-2 examines the presence or absence of a difference in level between the pixel Pi,j represented by the input signal from the coding part 11 of the false contour detector 3-2 and the pixel (pixel Pi−1,j) adjacent to the pixel Pi,j for each of the determined subfields (first SF to eleventh SF) with reference to reference memory 6. The contour detection part 12 of the false contour detector 3-2 outputs an input signal (pixel Pi,j) having contour detection values "0," "1," "1," "1," "0," "0," "0," "0," "0," "0," and "0" the first SF, second SF, third SF, fourth SF, fifth SF, sixth SF, seventh SF, eighth SF, ninth SF, tenth SF, and eleventh SF to the weighting part 14 of the false contour detector 3-2.

Next, the weighting part 14 of the false contour detector **3-*k* in the dynamic false contour reducing circuit 1 executes the weighting processing in a manner similar to the first embodiment (step S3 in FIG. 19**).

In the weighting processing, the weighting part 14 of the false contour detector 3-1 multiplies the contour detection values "1," "0," "0," "0," "0," "0," "0," "0," "0," "0," and "0," for the first SF, second SF, third SF, fourth SF, fifth SF, sixth SF, seventh SF, eighth SF, ninth SF, tenth SF, and eleventh SF of the input signal (pixel Pi,j) from the contour detection part 12 of the false contour detector 3-1 by the gradation levels "1," "2," "4," "7," "11," "20," "30," "40," "45," "45," and "50" as weighting coefficient, with reference to the gradation level setting memory 7, to generate false contour detection and "0" (see FIG. 20). The weighting part 14 of the false contour detector 3-1 outputs an input signal (pixel Pi,j) having the false contour detection values "1," "0," "0," "0," "0," "0," "0," "0," "0," "0," "0," and "0" for the first SF, second SF, third SF, fourth SF, fifth SF, sixth SF, seventh SF, eighth SF, ninth SF, tenth SF, and eleventh SF to the adder 15 of the false contour detector 3-1.

Also, in the weighting processing, the weighting part 14 of the false contour detector 3-2 multiplies the contour detection values "0," "1," "1," "1," "0," "0," "0," "0," "0," "0," and "0" for the first SF, second SF, third SF, fourth SF, fifth SF, sixth SF, seventh SF, eighth SF, ninth SF, tenth SF, and eleventh SF of the input signal (pixel Pi,j) from the contour detection part 12 of the false contour detector 3-2 by the gradation levels "1," "2," "4," "7" "11," "20," "30," "40," "45," "45," and "50" as weighting coefficients, with reference to the gradation level setting memory 7, to generate false contour detection and "0," "2," "4," "7," "0," "0," "0," "0," "0," "0," and "0" (see FIG. 21). The weighting part 14 of the false contour detector 3-2 outputs an input signal (pixel Pi,j) having the false contour detection values "0," "2," "4," "7," "0," "0," "0," "0," "0," "0," and "0" for the first SF, second SF, third SF, fourth SF, fifth SF, sixth SF, seventh SF, eighth SF, ninth SF, tenth SF, and eleventh SF to the adder 15 of the false contour detector 3-2.

Next, the adder 15 of the false contour detector **3-*k* in the dynamic false contour reducing circuit 1 executes the addition processing in a manner similar to the first embodiment (step S4 in FIG. 19**).

In the addition processing, the adder 15 of the false contour detector 3-1 calculates the total value of the false contour detection values "1," "0," "0," "0," "0," "0," "0," "0," "0," "0," and "0," for the first SF, second SF, third SF, fourth SF, fifth SF, sixth SF, seventh SF, eighth SF, ninth SF, tenth SF, and eleventh SF of the input signal (pixel Pi,j) from the weighting part 14 of the false contour detector 3-1, to generate a false contour magnitude $f_1$ "1" indicative of the total value. The adder 15 of the false contour detector 3-1 outputs an input signal (pixel Pi,j) having the false contour magnitude $f_1$ "1" to the visual sensitivity conversion part 16 of the false contour detector 3-1.

Also, in the addition processing, the adder 15 of the false contour detector 3-2 calculates the total value of the false contour detection values "0," "2," "4," "7," "0," "0," "0," "0," "0," "0," and "0" for the first SF, second SF, third SF, fourth SF, fifth SF, sixth SF, seventh SF, eighth SF, ninth SF, tenth SF, and eleventh SF of the input signal (pixel Pi,j) from the weighting part 14 of the false contour detector 3-2, and generates a false contour magnitude $f_1$ "13" indicative of the total value. The adder 15 of the false contour detector 3-1 outputs an input signal (pixel Pi,j) having the false contour magnitude $f_1$ "13" to the visual sensitivity conversion part 16 of the false contour detector 3-2.

Next, the visual sensitivity conversion part 16 of the false contour detector **3-*k* in the dynamic false contour reducing circuit 1 executes the visual sensitivity conversion processing (step S7 in FIG. 19**) in a manner similar to the first embodiment.

In the visual sensitivity conversion processing, the visual sensitivity conversion part 16 of the false contour detector 3-1 searches for a viewed false contour magnitude $f_2$ corresponding to the gradation level of the pixel Pi,j and the false contour magnitude $f_1$ "1" with reference to the visual sensitivity setting memory 9, and outputs an input signal (pixel Pi,j) having the viewed false contour magnitude $f_2$ thus retrieved to the selector 4 as a candidate pixel signal 8-1.

Also, in the visual sensitivity conversion processing, the visual sensitivity conversion part 16 of the false contour detector 3-2 searches for a viewed false contour magnitude $f_2$ corresponding to the gradation level of the pixel Pi,j and the false contour magnitude $f_1$ "13" with reference to the visual sensitivity setting memory 9, and outputs an input signal (pixel Pi,j) having the viewed false contour magnitude $f_2$ thus retrieved to the selector 4 as a candidate pixel signal 8-2.

Next, the selector 4 of the dynamic false contour reducing circuit 1 executes selection processing (step 5 in FIG. 19).

In the selection processing, the selection part 4 selects the candidate pixel signal 8-1 having the smallest false contour magnitude $f_2$ from the false contour magnitudes $f_2$ included in the candidate pixel signals 8-1, 8-2. The selector 4 outputs the candidate pixel signal 8-1 to the display controller 5, and stores the candidate pixel signal 8-1 in the reference memory 6 as an input signal for displaying an image at a peripheral pixel (pixel Pi,j).

Next, the display control part 5 of the dynamic false contour reducing circuit 1 executes the display processing (step S6 in FIG. 19) in a manner similar to the first embodiment.

In the display processing, the display controller 5 controls the display part 2 such that the candidate pixel signal 8-1 selected by the selector 4 is applied thereto to display the candidate pixel signal 8-1 representative of the gradation level "57" as an input signal (pixel Pi,j).

In Case (A), the gradation level "57" of the input signal (pixel Pi,j) can cause the dynamic false contour 100 to intensely appear due to a difference in level between the pixel Pi,j and peripheral pixel Pi−1,j in the six SF and seventh SF. In the display device 10 according to the second embodiment of the present invention, when the input signal (pixel Pi,j) has a gradation level in a range of 56 to 75 in Case A, the sixth SF and seventh SF are determined as the aforementioned first determined subfield group 21, so that the dynamic false contour 100 can be more precisely reduced than the first embodiment.

Next, the aforementioned Case (B-1) will be described. Assume that the pixel Pi−1,j (peripheral pixel), as a pixel adjacent to the pixel Pi,j which is the pixel of interest, has a gradation level of 205, and that the gradation levels of the first SF, second SF, third SF, fourth SF, fifth SF, sixth SF, eighth SF, ninth SF, tenth SF, and eleventh SF of the pixel Pi−1,j are set to "1," "2," "4," "7," "11," "20," "30," "40," "45," "45," and "0" (see FIG. 22). Assume that the gradation level of the pixel Pi,j is 210. Assume also that a flag indicated by selection information corresponding to the first gradation level range (gradation level range 40-5) and second gradation level range (gradation level range 40-6) stored in the range selection memory 19) is "0."

The dynamic false contour reducing circuit 10 is applied with an input signal for displaying an image at the pixel Pi,j as display data. In this event, the error diffusion part 17 of the dynamic false contour reducing circuit 1 executes error diffusion processing (step S8 in FIG. 19).

In the error diffusion processing, the error diffusion part 17 recognizes that the gradation level of the pixel Pi,j is "210." The error diffusion part 17 also recognizes that the gradation level of the input signal (pixel Pi,j) is included in the gradation level range 40-7 between the gradation level range 40-5 and gradation level range 40-6 with reference to the candidate gradation setting memory 18. The error diffusion part 17 further sets the gradation level of the input signal (pixel of interest Pi,j) to a spurious gradation level (a gradation level which is an upper limit value of the gradation level "176-205" represented by the gradation level range 40-5) "205," and selects the gradation level range 40-5 with reference to the range selection memory 19. The error diffusion part 17 determines a candidate subfield group (first SF to tenth SF) corresponding to the gradation level range 40-5 in the plurality of subfields (first SF to eleventh SF) with reference to the candidate gradation setting memory 18, and outputs an input signal (pixel of interest Pi,j) including the candidate subfield group (first SF to tenth SF) to the plurality of false contour detectors 3-1 to **3-*n*. This candidate subfield group (first SF to tenth SF) includes the first determined subfield group 21 (seventh SF to tenth SF) and the first SF to sixth SF which make up the selected candidate subfield group 22. The gradation level of the input signal (pixel of interest Pi,j) output from the error diffusion part 17** indicates 205.

Next, the coding part 11 of the false contour detector **3-*k* in the dynamic false contour reducing circuit 1 executes the coding processing (step S1 in FIG. 19**).

In the coding processing, the coding part 11 of the false contour detector 3-1 recognizes that the gradation level of the pixel Pi,j is "205." The coding part 11 of the false contour detector 3-1 determines a plurality of determined subfields (first SF to eleventh SF) with reference to the gradation level setting memory 7. The plurality of determined subfields (first SF to eleventh SF) includes the first determined subfield group (seventh SF to tenth SF), and a second determined subfield group (first SF to third SF) of the selected candidate subfield group 22 (first SF to sixth SF) of the selected candidate subfield group 22 (first SF to sixth SF) (see FIG. 22). The total value of the gradation levels of the first determined subfield group 21 (seventh SF to tenth SF) and the second determined subfield group (first SF to sixth SF) represents the gradation level of the pixel Pi,j. Specifically, the gradation levels of the first SF, second SF, third SF, fourth SF, fifth SF, sixth SF, seventh SF, eighth SF, ninth SF, tenth SF, and eleventh SF, which belong to the determined subfields, are "1," "2," "4," "7," "11," "20," "30," "40," "45," "45," and "0," respectively. The coding part 11 of the false contour detector 3-1 outputs the plurality of determined subfields (first SF to eleventh SF) to the contour detection part 12 of the false contour detector 3-1 as the first SF to eleventh SF of the input signal (pixel Pi,j).

Next, the false contour detection part 12 of the false contour detector **3-*k* in the dynamic false contour reducing circuit 1 executes the contour detection processing (step S2 in FIG. 19**) in a manner similar to the first embodiment.

In the contour detection processing, the contour detection part 12 of the false contour detector 3-1 examines the presence or absence of a difference in level between the pixel Pi,j represented by the input signal from the coding part 11 of the false contour detector 3-1 and a pixel (pixel Pi−1,j) adjacent to the pixel Pi,j for each of the determined subfields (first SF to eleventh SF) with reference to the reference memory 6. The contour detection part 12 of the false contour detector 3-1 outputs an input signal (pixel Pi,j) having contour detection values "0," "0," "0," "0," "0," "0," "0," "0," "0," "0," and "0," for the first SF, second SF, third SF, fourth SF, fifth SF, sixth SF, seventh SF, eighth SF, ninth SF, tenth SF, and eleventh SF to the weighting part 14 of the false contour detector 3-1.

Next, the weighting part 14 of the false contour detector **3-*k* in the dynamic false contour reducing circuit 1 executes the weighting processing in a manner similar to the first embodiment (step S3 in FIG. 19**).

In the weighting processing, the weighting part 14 of the false contour detector 3-1 multiplies the contour detection values "0," "0," "0," "0," "0," "0," "0," "0," "0," "0," and "0," for the first SF, second SF, third SF, fourth SF, fifth SF, sixth SF, seventh SF, eighth SF, ninth SF, tenth SF, and eleventh SF of the input signal (pixel Pi,j) from the contour detection part 12 of the false contour detector 3-1 by the gradation levels "1," "2," "4," "7," "11" "20," "30," "40," "45," "45," and "50" as weighting coefficients, with reference to the gradation level setting memory 7, to generate false contour detection values "1," "0," "0," "0," "0," "0," "0," "0," "0," "0," and "0" (see FIG. 22). The weighting part 14 of the false contour detector 3-1 outputs an input signal (pixel Pi,j) having the false contour detection values "0," "0," "0," "0," "0," "0," "0," "0," "0," "0," and "0" for the first SF, second SF, third SF, fourth SF, fifth SF, sixth SF, seventh SF, eighth SF, ninth SF, tenth SF, and eleventh SF to the adder 15 of the false contour detector 3-1.

Next, the adder 15 of the false contour detector **3-*k* in the dynamic false contour reducing circuit 1 executes the addition processing (step S4 in FIG. 19**) in a manner similar to the first embodiment.

In the addition processing, the adder 15 of the false contour detector 3-1 calculates the total value of the false contour detection values "0," "0," "0," "0," "0," "0," "0," "0," "0," "0," and "0," for the first SF, second SF, third SF, fourth SF, fifth SF, sixth SF, seventh SF, eighth SF, ninth SF, tenth SF, and eleventh SF of the input signal (pixel Pi,j) from the weighting part 14 of the false contour detector 3-1, to generate a false contour magnitude $f_1$ "0" indicative of the total value. The adder 15 of the false contour detector 3-1 outputs an input signal (pixel Pi,j) having the false contour magnitude $f_1$ "0" to the visual sensitivity conversion part 16 of the false contour detector 3-1.

Next, the visual sensitivity conversion part 16 of the false contour detector **3-*k* in the dynamic false contour reducing circuit 1 executes the visual sensitivity conversion processing (step S7 in FIG. 19**) in a manner similar to the first embodiment.

In the visual sensitivity conversion processing, the visual sensitivity conversion part 16 of the false contour detector 3-1 searches for a viewed false contour magnitude $f_2$ corresponding to the gradation level of the pixel Pi,j and the false contour magnitude $f_1$ "0" with reference to the visual sensitivity setting memory 9, and outputs an input signal (pixel Pi,j) having the viewed false contour magnitude $f_2$ thus retrieved to the selector 4 as a candidate pixel signal 8-1.

Next, the selector 4 of the dynamic false contour reducing circuit 1 executes the selection processing (step S5 in FIG. 19) in a manner similar to the first embodiment.

In the selection processing, the selection part 4 outputs the candidate pixel signal 8-1 having the smallest false contour magnitude $f_2$ to the display controller 5, and stores the candidate pixel signal 8-1 in the reference memory 6 as an input signal for displaying an image at a peripheral pixel (pixel Pi,j).

Next, the display control part 5 of the dynamic false contour reducing circuit 1 executes the display processing (step S6 in FIG. 19) in a manner similar to the first embodiment.

In the display processing, the display controller 5 controls the display part 2 such that the candidate pixel signal 8-1 from the selector 4 is applied thereto to display the candidate pixel signal 8-1 representative of the gradation level "205" as an input signal (pixel Pi,j).

In Case (B-1), the gradation level "210" of the input signal (pixel Pi,j) can cause the dynamic false contour 100 to intensely appear due to a difference in level between the pixel Pi,j and peripheral pixel Pi−1,j in the six SF to eleventh SF. In the display device 10 according to the second embodiment of the present invention, to solve this problem, when the input signal (pixel Pi,j) has a gradation level between the gradation level range 40-5 and the gradation level range 40-6 in Case (B-1), the gradation level of the input signal (pixel Pi,j) is set to a spurious gradation level (a gradation level which is an upper limit value of the gradation level range 40-5) "205" with reference to the candidate gradation setting memory 18 and range selection memory 19, and the gradation level range 40-5 is selected. In the display device 10 according to the second embodiment of the present invention, since the seventh SF to tenth SF are determined at all times as the first determined subfield group 21 when the gradation level of the input signal (pixel Pi,j) is in a range of "176-215" in Case (B-1), the dynamic false contour 100 can be more precisely reduced than the first embodiment.

Next, the aforementioned Case (B-2) will be described. Assume that the pixel Pi−1,j (peripheral pixel), as a pixel adjacent to the pixel Pi,j which is the pixel of interest, has a gradation level of 205, and that the gradation levels of the first SF, second SF, third SF, fourth SF, fifth SF, sixth SF, eighth SF, ninth SF, tenth SF, and eleventh SF of the pixel Pi−1,j are set to "1," "2," "4," "7," "11" "20," "30," "40," "45," "45," and "0" (see FIGS. 23 and 24). Assume that the gradation level of the pixel Pi,j is 210. Assume also that a flag indicated by selection information corresponding to the first gradation level range (gradation level range 40-5) and second gradation level range (gradation level range 40-6) stored in the range selection memory 19) is "1."

The dynamic false contour reducing circuit 10 is applied with an input signal for displaying an image at the pixel Pi,j as display data. In this event, the error diffusion part 17 of the dynamic false contour reducing circuit 1 executes the error diffusion processing (step S8 in FIG. 19).

In the error diffusion processing, the error diffusion part 17 recognizes that the gradation level of the pixel Pi,j is "210." The error diffusion part 17 also recognizes that the gradation level of the input signal (pixel Pi,j) is included in the gradation level range 40-7 between the gradation level range 40-5 and gradation level range 40-6 with reference to the candidate gradation setting memory 18. The error diffusion part 17 further sets the gradation level of the input signal (pixel of interest Pi,j) to a spurious gradation level (a gradation level which is a lower limit value of the gradation level "216-255" represented by the gradation level range 40-6) "216," and selects the gradation level range 40-6 with reference to the range selection memory 19. The error diffusion part 17 determines a candidate subfield group (first SF to eleventh SF) corresponding to the gradation level range 40-6 in the plurality of subfields (first SF to eleventh SF) with reference to the candidate gradation setting memory 18, and outputs an input signal (pixel of interest Pi,j) including the candidate subfield group (first SF to eleventh SF) to the plurality of false contour detectors 3-1 to **3-*n*. This candidate subfield group (first SF to eleventh SF) includes the first determined subfield group 21 (eighth SF to eleventh SF) and the first SF to seventh SF which make up the selected candidate subfield group 22. The gradation level of the input signal (pixel of interest Pi,j) output from the error diffusion part 17** indicates 216.

Next, the coding part 11 of the false contour detector **3-*k* in the dynamic false contour reducing circuit 1 executes the coding processing (step S1 in FIG. 19**).

In the coding processing, the coding part 11 of the false contour detector 3-1 recognizes that the gradation level of the pixel Pi,j is "216." The coding part 11 of the false contour detector 3-1 determines a plurality of determined subfields (first SF to eleventh SF) with reference to the gradation level setting memory 7. The plurality of determined subfields (first SF to eleventh SF) includes the first determined subfield group 21 (eighth SF to eleventh SF), and a second determined subfield group (first SF, third SF, fifth SF, and sixth SF) of the selected candidate subfield group 22 (first SF to seventh SF) (see FIG. 23). The total value of the gradation levels of the first determined subfield group 21 (eighth SF to eleventh SF) and the second determined subfield group (first SF, third SF, fifth SF, and sixth SF) represents the gradation level of the pixel Pi,j. Specifically, the gradation levels of the first SF, second SF, third SF, fourth SF, fifth SF, sixth SF, seventh SF, eighth SF, ninth SF, tenth SF, and eleventh SF, which belong to the determined subfields, are "1," "0," "4," "0," "11," "20," "0," "40," "45," "45," and "50," respectively. The coding part 11 of the false contour detector 3-1 outputs the plurality of determined subfields (first SF to eleventh SF) to the contour detection part 12 of the false contour detector 3-1 as the first SF to eleventh SF of the input signal (pixel Pi,j).

Also, in the coding processing, the coding part 11 of the false contour detector 3-2 recognizes that the gradation level of the pixel Pi,j is "216." The coding part 11 of the false contour detector 3-2 determines a plurality of determined subfields (first SF to eleventh SF) with reference to the gradation level setting memory 7. The plurality of determined subfields (first SF to eleventh SF) includes the first determined subfield group 21 (eighth SF to eleventh SF), and a second determined subfield group (second SF, third SF, and seventh SF) of the selected candidate subfield group 22 (first SF to seventh SF) (see FIG. 24). The total value of the gradation levels of the first determined subfield group 21 (eighth SF to eleventh SF) and the second determined subfield group (second SF, third SF, and seventh SF) represents the gradation level of the pixel Pi,j. Specifically, the gradation levels of the first SF, second SF, third SF, fourth SF, fifth SF, sixth SF, seventh SF, eighth SF, ninth SF, tenth SF, and eleventh SF, which belong to the determined subfields, are "0," "2," "4," "0," "0," "0," "30," "40," "45," "45," and "50," respectively. The coding part 11 of the false contour detector 3-2 outputs the plurality of determined subfields (first SF to eleventh SF) to the contour detection part 12 of the false contour detector 3-2 as the first SF to eleventh SF of the input signal (pixel Pi,j).

Next, the false contour detection part 12 of the false contour detector **3-*k* in the dynamic false contour reducing circuit 1 executes the contour detection processing (step S2 in FIG. 19**) in a manner similar to the first embodiment.

In the contour detection processing, the contour detection part 12 of the false contour detector 3-1 examines the presence or absence of a difference in level between the pixel Pi,j represented by the input signal from the coding part 11 of the false contour detector 3-1 and a pixel (pixel Pi−1,j) adjacent to the pixel Pi,j for each of the determined subfields (first SF to eleventh SF) with reference to the reference memory 6. The contour detection part 12 of the false contour detector 3-1 outputs an input signal (pixel Pi,j) having contour detection values "0," "1," "0," "1," "0," "0," "1," "0," "0," "0," and "1,"

for the first SF, second SF, third SF, fourth SF, fifth SF, sixth SF, seventh SF, eighth SF, ninth SF, tenth SF, and eleventh SF to the weighting part 14 of the false contour detector 3-1.

Also, in the contour detection processing, the contour detection part 12 of the false contour detector 3-2 examines the presence or absence of a difference in level between the pixel Pi,j represented by the input signal from the coding part 11 of the false contour detector 3-2 and a pixel (pixel Pi−1,j) adjacent to the pixel Pi,j for each of the determined subfields (first SF to eleventh SF) with reference to the reference memory 6. The contour detection part 12 of the false contour detector 3-2 outputs an input signal (pixel Pi,j) having contour detection values "1," "0," "0," "1," "1," "1," "0," "0," "0," "0," and "1" for the first SF, second SF, third SF, fourth SF, fifth SF, sixth SF, seventh SF, eighth SF, ninth SF, tenth SF, and eleventh SF to the weighting part 14 of the false contour detector 3-2.

Next, the weighting part 14 of the false contour detector **3-*k* in the dynamic false contour reducing circuit 1 executes the weighting processing in a manner similar to the first embodiment (step S3 in FIG. 19**).

In the weighting processing, the weighting part 14 of the false contour detector 3-1 multiplies the contour detection values "0," "1," "0," "1," "0," "0," "1," "0," "0," "0," and "1," for the first SF, second SF, third SF, fourth SF, fifth SF, sixth SF, seventh SF, eighth SF, ninth SF, tenth SF, and eleventh SF of the input signal (pixel Pi,j) from the contour detection part 12 of the false contour detector 3-1 by the gradation levels "1," "2," "4," "7," "11," "20," "30," "40," "45," "45," and "50," as weighting coefficients, with reference to the gradation level setting memory 7, to generate false contour detection values "0," "2," "0," "7," "0," "0," "30," "0," "0," "0," and "50" (see FIG. 23). The weighting part 14 of the false contour detector 3-1 outputs an input signal (pixel Pi,j) having the false contour detection values "0," "2," "0," "7," "0," "0," "30," "0," "0," "0," and "50" for the first SF, second SF, third SF, fourth SF, fifth SF, sixth SF, seventh SF, eighth SF, ninth SF, tenth SF, and eleventh SF to the adder 15 of the false contour detector 3-1.

Also, in the weighting processing, the weighting part 14 of the false contour detector 3-2 multiplies the contour detection values "1," "0," "0," "1," "1," "1," "0," "0," "0," "0," and "1" for the first SF, second SF, third SF, fourth SF, fifth SF, sixth SF, seventh SF, eighth SF, ninth SF, tenth SF, and eleventh SF of the input signal (pixel Pi,j) from the contour detection part 12 of the false contour detector 3-2 by the gradation levels "1," "2," "4," "7," "11," "20," "30," "40," "45," "45," and "50" as weighting coefficients, with reference to the gradation level setting memory 7, to generate false contour detection values "1," "0," "0," "7," "11," "20," "0," "0," "0," "0," and "50" (see FIG. 24). The weighting part 14 of the false contour detector 3-2 outputs an input signal (pixel Pi,j) having the false contour detection values "1," "0," "0," "7," "11," "20," "0," "0," "0," "0," and "50" for the first SF, second SF, third SF, fourth SF, fifth SF, sixth SF, seventh SF, eighth SF, ninth SF, tenth SF, and eleventh SF to the adder 15 of the false contour detector 3-2.

Next, the adder 15 of the false contour detector **3-*k* in the dynamic false contour reducing circuit 1 executes the addition processing (step S4 in FIG. 19**) in a manner similar to the first embodiment.

In the addition processing, the adder 15 of the false contour detector 3-1 calculates the total value of the false contour detection values "0," "2," "0," "7," "0," "0," "30," "0," "0," "0," and "50" for the first SF, second SF, third SF, fourth SF, fifth SF, sixth SF, seventh SF, eighth SF, ninth SF, tenth SF, and eleventh SF of the input signal (pixel Pi,j) from the weighting part 14 of the false contour detector 3-1, to generate a false contour magnitude $f_1$ "89" indicative of the total value. The adder 15 of the false contour detector 3-1 outputs an input signal (pixel Pi,j) having the false contour magnitude $f_1$ "89" to the visual sensitivity conversion part 16 of the false contour detector 3-1.

Also, in the addition processing, the adder 15 of the false contour detector 3-2 calculates the total value of the false contour detection values "1," "0," "0," "7," "11," "20," "0," "0," "0," "0," and "50" for the first SF, second SF, third SF, fourth SF, fifth SF, sixth SF, seventh SF, eighth SF, ninth SF, tenth SF, and eleventh SF of the input signal (pixel Pi,j) from the weighting part 14 of the false contour detector 3-1, to generate a false contour magnitude $f_1$ "89" indicative of the total value. The adder 15 of the false contour detector 3-2 outputs an input signal (pixel Pi,j) having the false contour magnitude $f_1$ "89" to the visual sensitivity conversion part 16 of the false contour detector 3-2.

Next, the visual sensitivity conversion part 16 of the false contour detector **3-*k* in the dynamic false contour reducing circuit 1 executes the visual sensitivity conversion processing (step S7 in FIG. 19**) in a manner similar to the first embodiment.

In the visual sensitivity conversion processing, each of the visual sensitivity conversion parts 16 of the false contour detectors 3-1, 3-2 searches for a viewed false contour magnitude $f_2$ corresponding to the gradation level of the pixel Pi,j and the false contour magnitude $f_1$ "89" with reference to the visual sensitivity setting memory 9, and outputs an input signal (pixel Pi,j) having the viewed false contour magnitude $f_2$ thus retrieved to the selector 4 as a candidate pixel signal 8-1, 8-2.

Next, the selector 4 of the dynamic false contour reducing circuit 1 executes the selection processing (step S5 in FIG. 19) in a manner similar to the first embodiment.

In the selection processing, the selection part 4 selects the candidate pixel signal 8-1 or candidate pixel signal 8-2 having the smallest false contour magnitude $f_2$ from among the false contour magnitudes $f_2$ included in the candidate pixel signals 8-1, 8-2. For example, when the candidate signal 8-1 is selected by the selector 4, the selector 4 outputs the candidate pixel signal 8-1 to the display controller 5, and stores the candidate pixel signal 8-1 in the reference memory 6 as an input signal for displaying an image at a peripheral pixel (pixel Pi,j).

Next, the display control part 5 of the dynamic false contour reducing circuit 1 executes the display processing (step S6 in FIG. 19) in a manner similar to the first embodiment.

In the display processing, the display controller 5 controls the display part 2 such that the candidate pixel signal 8-1 selected by the selector 4 is applied thereto to display the candidate pixel signal 8-1 representative of the gradation level "216" as an input signal (pixel Pi,j).

In Case (B-2), the gradation level "210" of the input signal (pixel Pi,j) can cause the dynamic false contour 100 to intensely appear due to a difference in level between the pixel Pi,j and peripheral pixel Pi−1,j in the six SF to eleventh SF. In the display device 10 according to the second embodiment of the present invention, to solve this problem, when the input signal (pixel Pi,j) has a gradation level between the gradation level range 40-5 and the gradation level range 40-6 in Case (B-2), the gradation level of the input signal (pixel Pi,j) is set to a spurious gradation level (a gradation level which is a lower limit value of the gradation level range 40-6) "216" with reference to the candidate gradation setting memory 18 and range selection memory 19, and the gradation level range 40-6 is selected. In the display device 10 according to the second embodiment of the present invention, since the eighth SF to eleventh SF are determined at all times as the first determined subfield group 21 when the gradation level of the input signal (pixel Pi,j) is in a range of "206-255" in Case (B-2), the dynamic false contour 100 can be more precisely reduced than the first embodiment.

In the display device 10 according to the second embodiment of the present invention, input signals each for displaying an image at a pixel Pi,j are sequentially applied to the dynamic false contour reducing circuit 1 as display data, however, the present invention is not limited to this manner of applying input signals. The dynamic false contour reducing circuit 1 can receive an input signal for displaying an image at each pixel as display data, store the input signals in the reference memory 6, and execute the aforementioned error diffusion processing (step S8), coding processing (step S1), contour detection processing (step S2), weighting processing (step S3), addition processing (step S4), visual sensitivity conversion processing (step S7), selection processing (step S5), and display processing (step S6) for 3×3 pixels. In this event, when a pixel of interest is chosen to be a pixel Pi,j, peripheral pixels include pixels Pi−1,j−1, Pi,j−1, Pi−1,j−1, Pi−1,j, Pi+1,j, Pi−1,j+1, Pi,j+1, and Pi−1,j+1.

Third Embodiment

The third embodiment will be described in connection with an example in which the error diffusion processing is performed for a pixel signal, for example, in accordance with the level $f_2$ of a viewed false contour magnitude of the pixel signal.

Figure 25:
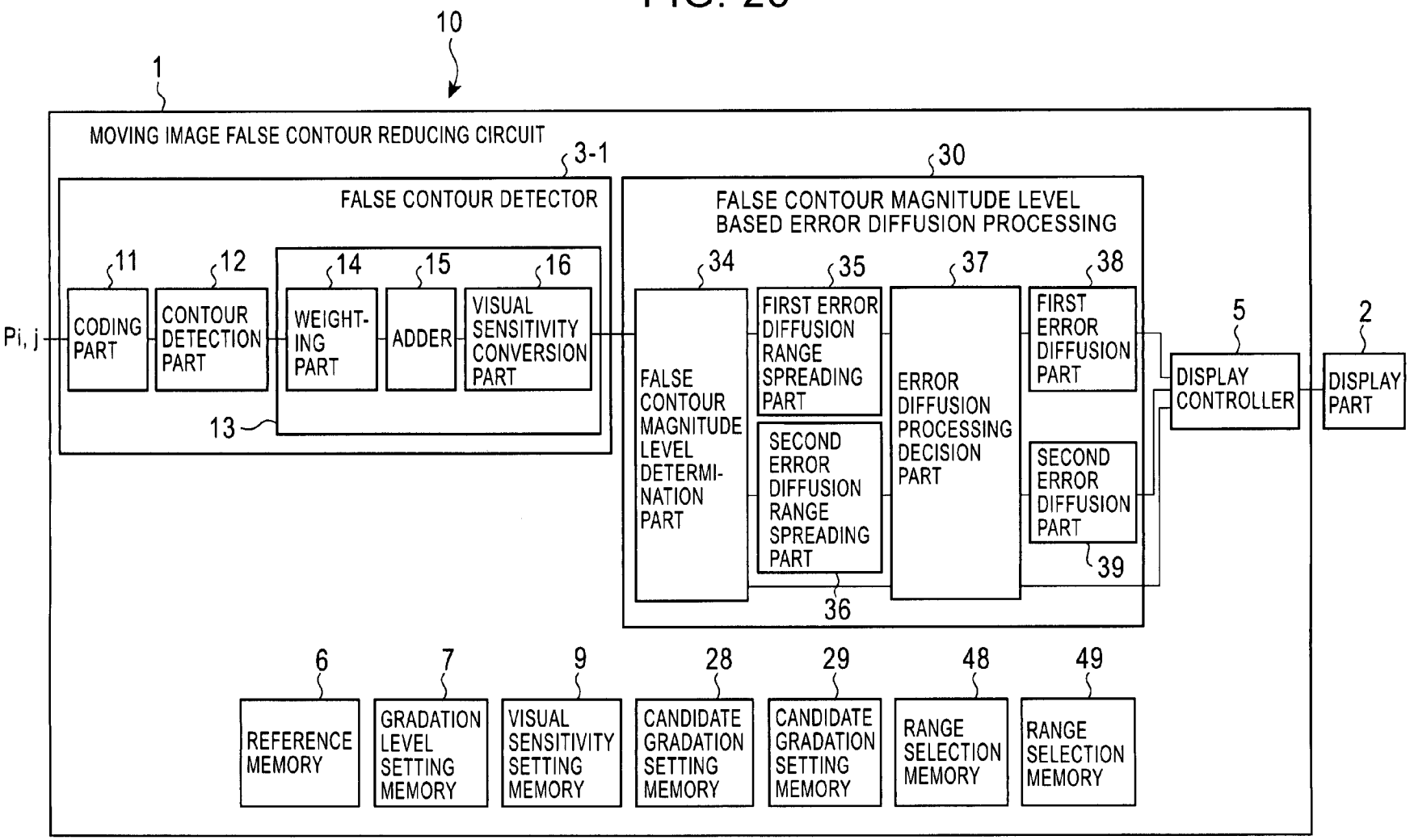
FIG. 25 is a block diagram showing the configuration of a third embodiment of the display device according to the present invention.
Figure 26:
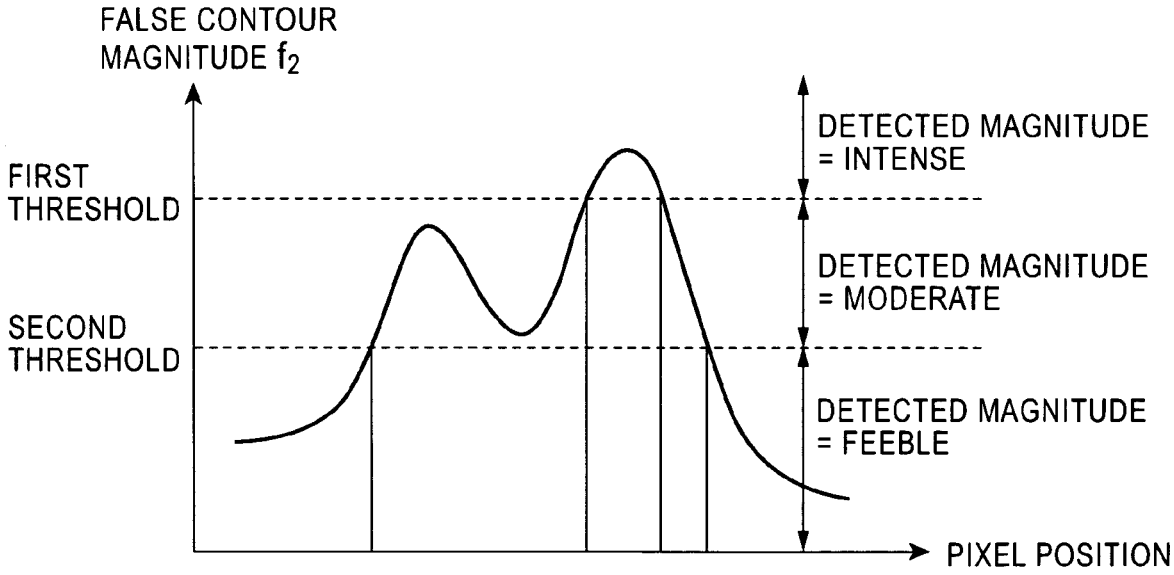
FIG. 26 is a diagram for explaining the operation of the third embodiment of the display device according to the present invention.

A dynamic false contour reducing method according to the third embodiment is implemented by a display device 10 as shown in FIG. 25. FIG. 25 is a block diagram showing the configuration of the display device 10 according to the third embodiment of the present invention. In the third embodiment, components identical to those in the first embodiment are designated the same reference numerals. A dynamic false contour reducing circuit 1 of the display device 10 according to the third embodiment of the present invention comprises the false contour detector 3-1, reference memory 6, gradation level setting memory 7, and visual sensitivity setting memory 9 of the display device 10 according to the first embodiment. In addition, the dynamic false contour reducing circuit 1 of the display device 10 according to the third embodiment of the present invention comprises a false contour magnitude level based error diffusion processing part 30, candidate gradation setting memories 28, 29, and range selection memories 48, 49.

The false contour detector 3-1 is configured in a manner similar to the first embodiment, and operates in a manner similar to the first embodiment. Specifically, the false contour detector 30 outputs the false contour magnitude $f_2$.

The false contour magnitude level based error diffusion processing part 30 is applied with the false contour magnitude $f_2$ from the false contour detector 3-1.

The false contour magnitude level based error diffusion processing part 30 comprises a false contour magnitude level determination part 34 for determining the level of the false contour magnitude $f_2$ of a pixel signal; a first error diffusion range spreading part 35 for spreading an error diffusion range when the false contour magnitude $f_2$ is high; a second error diffusion range spreading part 36 for spreading an error diffusion range when the false contour magnitude $f_2$ is moderate; an error diffusion processing decision part 37 for deciding the type of error diffusion processing for a corresponding pixel signal; a first error diffusion processing part 38 for performing intense error diffusion processing; and a second error diffusion processing part 39 for performing feeble error diffusion processing.

Among the foregoing components, the false contour magnitude level determination part 34 determines whether the level of the false contour magnitude $f_2$ is "high," "moderate," or "feeble" by a comparison of the false contour magnitude $f_2$ with a first threshold and a second threshold (second threshold<first threshold). Specifically, the false contour magnitude level determination part 34 determines that the level of the false contour magnitude $f_2$ is high when the false contour magnitude $f_2$ is higher than the first threshold (first threshold<false contour magnitude $f_2$); determines that the level of the false contour magnitude $f_2$ is moderate when the false contour magnitude $f_2$ is higher than the second threshold and is equal to or lower than the first threshold (second threshold<false contour magnitude $f_2$=first threshold); and determines that the level of the false contour magnitude $f_2$ is feeble when the false contour magnitude $f_2$ is equal to or lower than the second threshold (false contour magnitude $f_2$=second threshold).

Upon determination that the level of the false contour magnitude $f_2$ is high, the false contour magnitude level determination part 34 outputs a pixel signal appended with data indicating to that effect to the first error diffusion range spreading part 35. Upon determination that the level of the false contour magnitude $f_2$ is moderate, the false contour magnitude level determination part 34 outputs the pixel signal appended with data indicating to that effect to the second error diffusion range spreading part 36. Upon determination that the level of the false contour magnitude $f_2$ is feeble, the false contour magnitude level determination part 34 outputs the pixel signal appended with data indicating to that effect to the error diffusion processing decision part 37.

Figure 27:
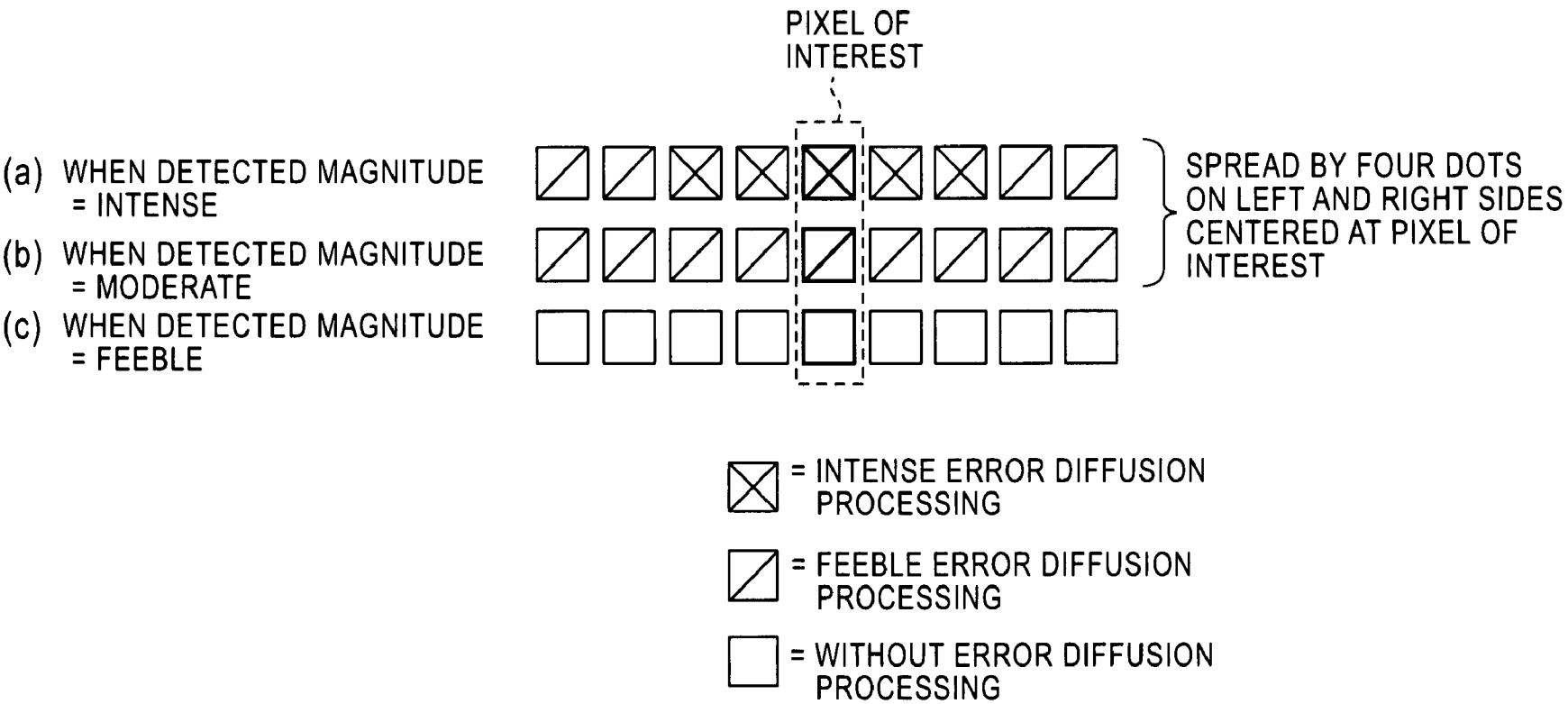
FIG. 27 is a diagram for explaining the operation of the third embodiment of the display device according to the present invention.

The first error diffusion range spreading part 35, upon receipt of the pixel signal appended with data indicating that the level of the false contour magnitude $f_2$ is high from the false contour magnitude level determination part 35, performs processing for spreading an error diffusion range in a manner shown in an upper row of FIG. 27(*a*). Specifically, the first error diffusion range spreading part 35 spreads a range which is subjected to the error diffusion processing by four pixels each to the left and to the right about a target pixel. Moreover, the first error diffusion range spreading part 35 decides that intense error diffusion processing is performed over a range including two pixels each to the left and to the right about the target pixel, and preliminarily decides that feeble error diffusion processing is performed over a range including two pixels each to the left and to the right of the range subjected to the intense error diffusion processing. Moreover, the first error diffusion range spreading part 35 outputs data indicative of the contents of the preliminary decision and the pixel signal to the corresponding error diffusion processing decision part 37, and outputs the data indicative of the contents of the preliminary decision to the error diffusion processing decision part 37 corresponding to the four left and right pixels.

On the other hand, the second error diffusion range spreading part 36, upon receipt of the pixel signal appended with data indicating that the level of the false contour magnitude $f_2$ is moderate from the false contour magnitude level determination part 35, performs processing for spreading an error diffusion range in a manner shown in a middle row of FIG. 27(*b*). Specifically, a range subjected to the error diffusion processing is spread by four pixels each to the left and to the right about a target pixel. In this event, the second error diffusion range spreading part 36 preliminarily decides that feeble error diffusion processing is performed over a range which extends over four pixels to the left and to the right about the target pixel. Further, the second error diffusion range spreading part 36 outputs data indicative of the contents of the preliminary decision and the pixel signal to the corresponding error diffusion processing decision part 37, and outputs the data indicative of the contents of the preliminary decision to the error diffusion processing decision part 37 corresponding to the four left and right pixels.

Figure 28:
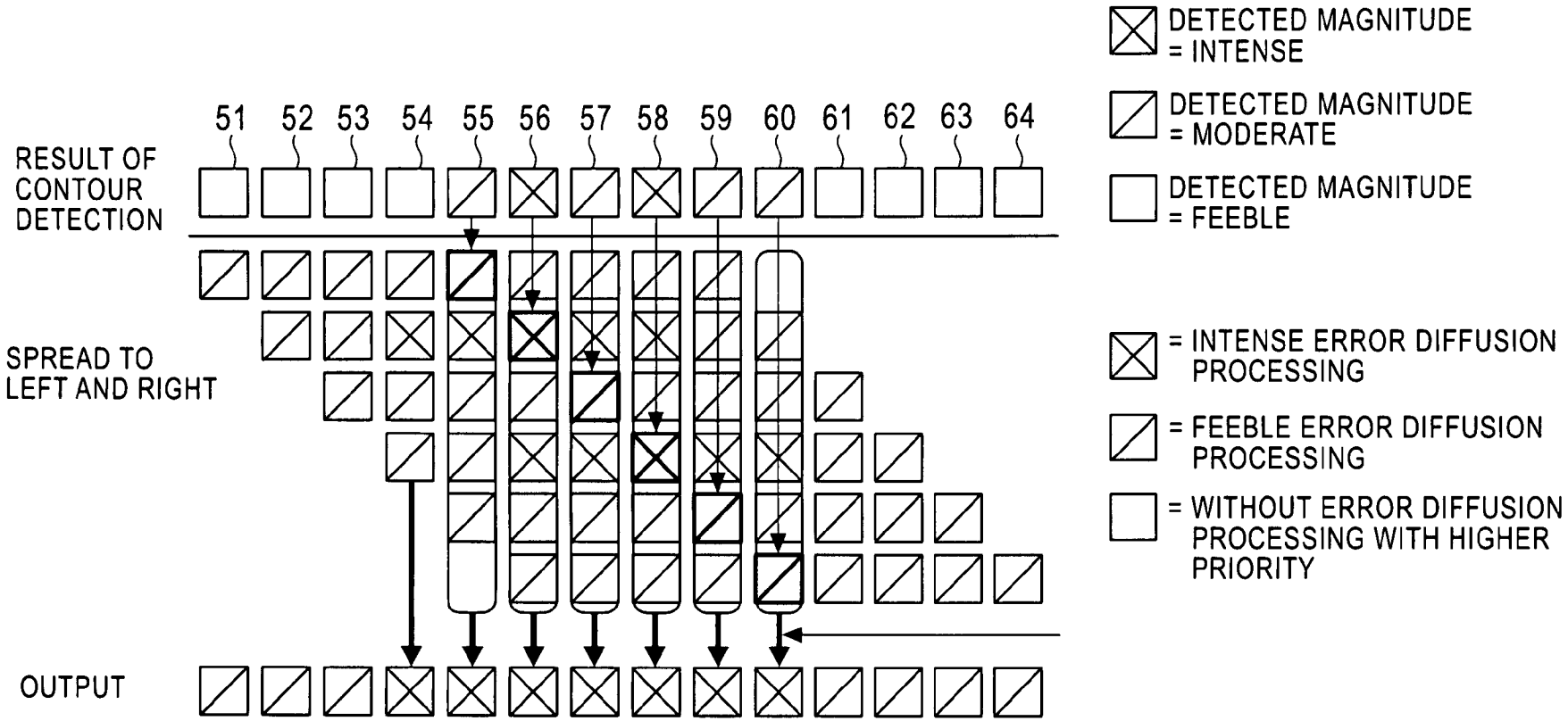
FIG. 28 is a diagram for explaining the operation of the third embodiment of the display device according to the present invention.

Here, as a result of a level determination made on the false contour magnitude $f_2$ by the corresponding false contour magnitude level determination part 34 for pixels 51, 52, 53, 54, 55, 56, 57, 58, 59, 60, 61, 62, 63, 64 which are arranged from left to right as shown in FIG. 28, assume, for example, that the level of the false contour magnitude $f_2$ is determined to be intense for the pixels 56 and 58; the level of the false contour magnitude $f_2$ is determined to be moderate for the pixels 55, 57, 59, 60; and the level of the false contour magnitude $f_2$ is feeble for the remaining pixels 51, 52, 53, 54, 61, 62, 63, 64.

In this event, it is preliminarily decided that the feeble error diffusion processing is performed for a range which includes the target pixel 55 and four pixels each on the left and right sides of the target pixel 55 (pixels 51-59). Similarly, it is preliminarily decided that the intense error diffusion processing is performed for a range which includes the target pixel 56 and two pixels each on the left and right sides of the target pixel 56 (pixels 54-58); and the feeble error diffusion processing is performed for a range which includes two pixels each on the left and right sides of that range including the pixels 54-58 (pixels 52, 53, 59, 60). Similarly, it is preliminarily decided that the feeble error diffusion processing is performed for a range which includes the target pixel 57 and four pixels each on the left and right sides of the target pixel 57 (pixels 53-61). Similarly, it is preliminarily decided that the intense error diffusion processing is performed for a range which includes the target pixel 55 and two pixels each on the left and right sides of the target pixel 55 (pixels 56-60), and the feeble error diffusion processing is performed for a range which includes two pixels each on the left and right sides of the range including the pixels 56-60 (pixels 54, 55, 61, 62). Similarly, it is preliminarily decided that the feeble error diffusion processing is performed for a range which includes the target pixel 59 and four pixels each on the left and right sides of the target pixel 59 (pixels 55-63). Similarly, it is preliminarily decided that the feeble error diffusion processing is performed for a range which includes the target pixel 60 and four pixels each on the left and right sides of the target pixel 60 (pixels 56-64).

Thus, at the stage of the preliminary decisions made by the first and second error diffusion range spreading parts 35, 36, there can be a pixel for which two preliminary decisions are made, i.e., a preliminary decision declaring that the intense error diffusion processing should be performed and a preliminary decision declaring that the feeble error diffusion processing should be performed, for example, as the pixel 55.

When two preliminary decisions are made that one pixel is subjected to both the intense error diffusion processing and feeble error diffusion processing, the error diffusion processing decision part 37 gives a higher priority to the preliminary decision of the intense error diffusion processing.

As a result, in the example shown in FIG. 28, a decision (definite decision) is made that the intense error diffusion processing is performed for the pixels 54-60.

For the pixels 51-53, 61-64, a decision is made as to whether the feeble error diffusion processing or intense error diffusion processing is performed in accordance with the result of the determination on the level of the false contour magnitude $f_2$ for pixels in ranges on both the left and right sides, not shown in FIG. 28.

In this way, each error diffusion processing decision part 37 decides whether the feeble error diffusion processing or intense error diffusion processing is performed, or whether any error diffusion processing is not performed for a corresponding pixel signal.

Each error diffusion processing decision part 37 outputs a corresponding pixel signal to the first error diffusion part 38 when it decides that the intense error diffusion processing is performed for the pixel signal; outputs a corresponding pixel signal to the second error diffusion part 39 when it decides that the feeble error diffusion processing is performed for the pixel signal; and outputs a pixel signal to the display controller 5 when it decides that no error diffusion processing is performed for the pixel signal.

Figure 29:
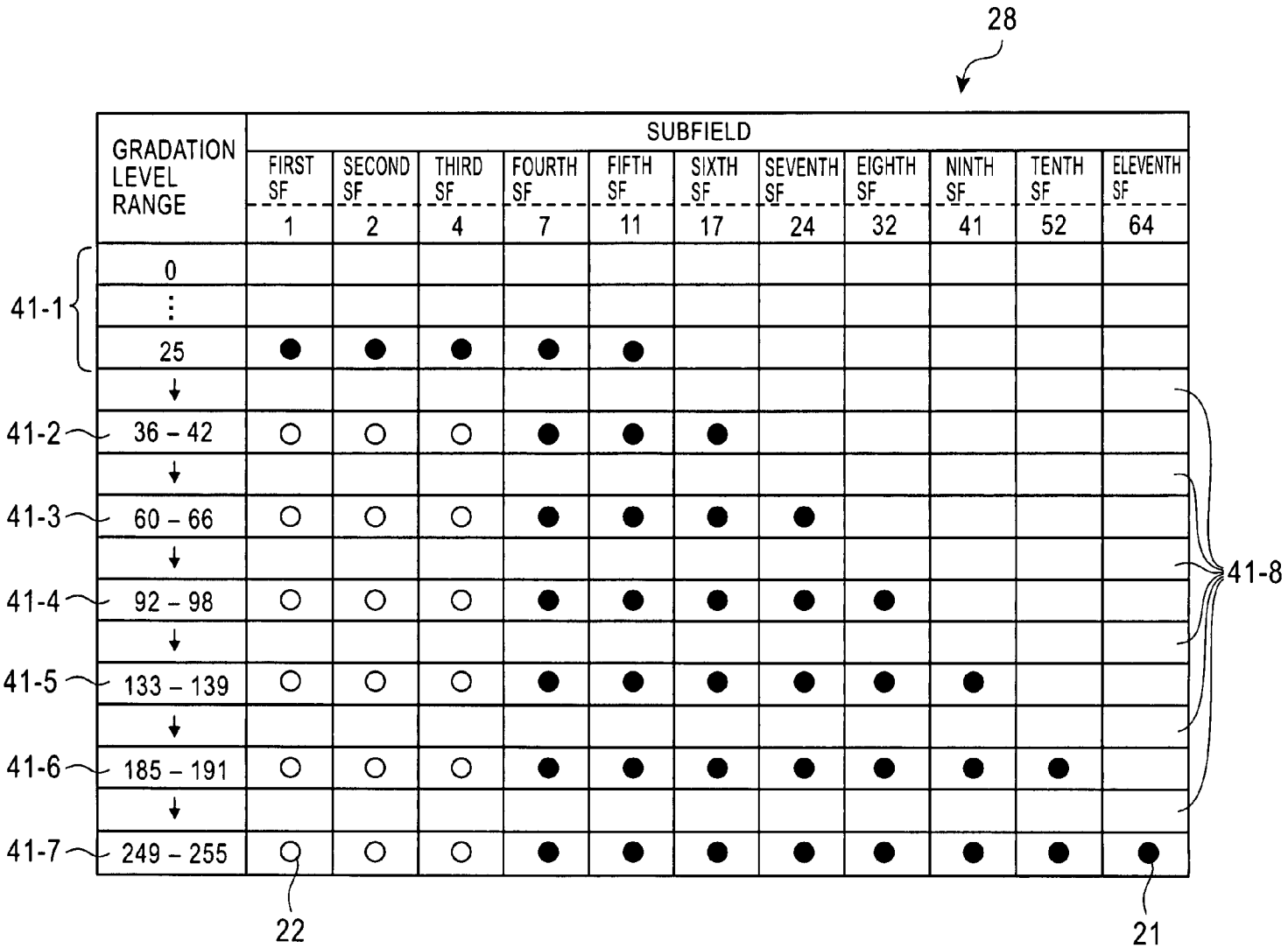
FIG. 29 is a diagram for explaining the operation of the third embodiment of the display device according to the present invention.

The first error diffusion part 38 uses the candidate gradation setting memory 28 shown in FIG. 29 for performing the intense error diffusion processing.

Figure 30:
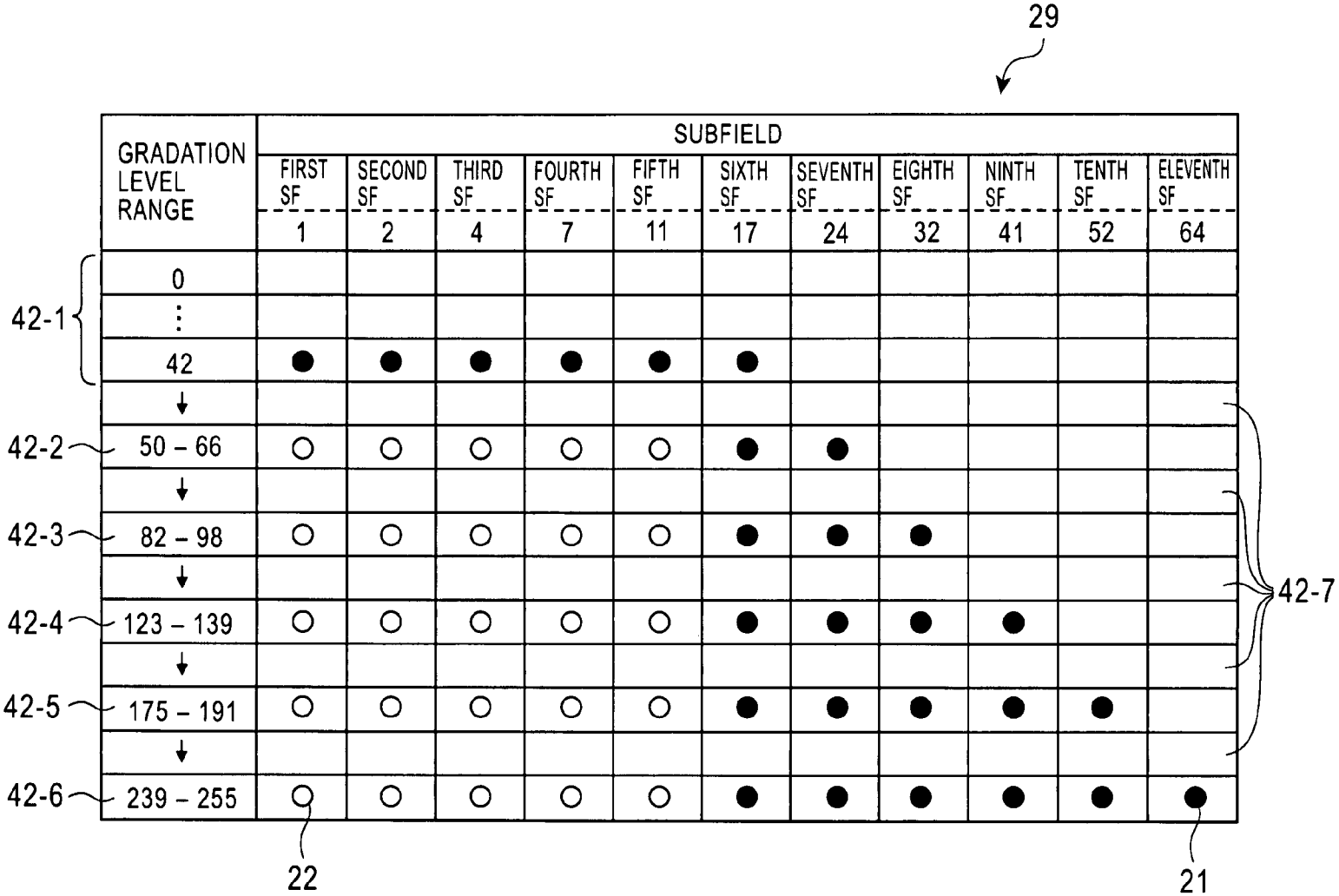
FIG. 30 is a diagram for explaining the operation of the third embodiment of the display device according to the present invention.

The second error diffusion part 39 in turn uses the candidate gradation setting memory 29 shown in FIG. 30 for performing the feeble error diffusion processing.

The candidate gradation setting memory 28 shown in FIG. 29 stores a plurality of gradation level ranges 41-1 to 41-8 and a plurality of subfields (first SF to m-th SF) in correspondence to each other.

Like the first embodiment, assume that the foregoing value m is, for example, 11 (m=11). The first SF, second SF, third SF, fourth SF, fifth SF, sixth SF, seventh SF, eighth SF, ninth SF, tenth SF, and eleventh SF stored in the candidate gradation setting memory 28 represent gradation levels "1," "2," "4," "7," "11," "17," "24," "32," "41," "52," and "64," respectively.

In the plurality of gradation level ranges 41-1 to 41-8 the gradation level range 41-1 represents the range of gradation levels "0-25." When the gradation level of a pixel signal is included in the gradation level range 41-1, the gradation level is relatively low, so that it is not necessary to previously determine a subfield group (first determined subfield group 21) which is set to a gradation level representative of lit state (other than black). In other words, the first determined subfield group 21 corresponding to the gradation level range 41-1 need not be set in the candidate gradation setting memory 28. In this event, the first error diffusion part 38 outputs a pixel signal to the display controller 5 with reference to the candidate gradation setting memory 28.

In the plurality of gradation level ranges 41-1 to 41-8, the gradation level range 41-2 represents the range of gradation levels "36-42." When the gradation level of a pixel signal is included in the gradation level range 41-2, the fourth, fifth, and sixth SFs are previously determined as a subfield group which has been set to a gradation level representative of lit state (other than black). Specifically, the fourth, fifth, and sixth SFs are set in the candidate gradation setting memory 28 as a first determined subfield group 21 corresponding to the gradation level range 41-2. In this event, the first error diffusion part 38 determines a candidate subfield group (first SF to sixth SF) corresponding to the gradation level range 41-2 in a plurality of subfields (first SF to eleventh SF) with reference to the candidate gradation setting memory 28, and outputs a pixel signal including the candidate subfield group (first SF to sixth SF) to the display controller 5. The candidate subfield group (first SF to sixth SF) includes the first determined subfield group 21 (fourth SF, fifth SF, sixth SF) and the first SF to third SF which make up a selected candidate subfield group 22.

In the plurality of gradation level ranges 41-1 to 41-8, the gradation level range 41-3 represents the range of gradation levels "60-66." When the gradation level of a pixel signal is included in the gradation level range 41-3, the fourth SF to seventh SF are previously determined as the first determined subfield group 21. Specifically, the fourth SF to seventh SF are set in the candidate gradation setting memory 28 as the first determined subfield group 21 corresponding to the gradation level range 41-3. In this event, the first error diffusion part 38 determines a candidate subfield group (first SF to seventh SF) corresponding to the gradation level range 41-3 in a plurality of subfields (first SF to eleventh SF) with reference to the candidate gradation setting memory 28, and outputs a pixel signal including the candidate subfield group (first SF to seventh SF) to the display controller 5. The candidate subfield group (first SF to seventh SF) includes the first determined subfield group 21 (fourth SF to seventh SF) and the first SF to third SF which make up the selected candidate subfield group 22.

In the plurality of gradation level ranges 41-1 to 41-8, the gradation level range 41-4 represents the range of gradation levels "92-98." When the gradation level of a pixel signal is included in the gradation level range 41-4, the fourth SF to eighth SF are previously determined as the first determined subfield group 21. Specifically, the fourth SF to eighth SF are set in the candidate gradation setting memory 28 as the first determined subfield group 21 corresponding to the gradation level range 41-4. In this event, the first error diffusion part 38 determines a candidate subfield group (first SF to eighth SF) corresponding to the gradation level range 41-4 in a plurality of subfields (first SF to eleventh SF) with reference to the candidate gradation setting memory 28, and outputs a pixel signal including the candidate subfield group (first SF to eighth SF) to the display controller 5. The candidate subfield group (first SF to eighth SF) includes the first determined subfield group 21 (fourth SF to eighth SF) and the first SF to third SF which make up the selected candidate subfield group 22.

In the plurality of gradation level ranges 41-1 to 41-8, the gradation level range 41-5 represents the range of gradation levels "133-139." When the gradation level of a pixel signal is included in the gradation level range 41-5, the fourth SF to ninth SF are previously determined as the first determined subfield group 21. Specifically, the fourth SF to ninth SF are set in the candidate gradation setting memory 28 as the first determined subfield group 21 corresponding to the gradation level range 41-5. In this event, the first error diffusion part 38 determines a candidate subfield group (first SF to ninth SF) corresponding to the gradation level range 41-5 in a plurality of subfields (first SF to eleventh SF) with reference to the candidate gradation setting memory 28, and outputs a pixel signal including the candidate subfield group (first SF to ninth SF) to the display controller 5. The candidate subfield group (first SF to ninth SF) includes the first determined subfield group 21 (fourth SF to ninth SF) and the first SF to third SF which make up the selected candidate subfield group 22.

In the plurality of gradation level ranges 41-1 to 41-8, the gradation level range 41-6 represents the range of gradation levels "185-191." When the gradation level of a pixel signal is included in the gradation level range 41-6, the fourth SF to tenth SF are previously determined as the first determined subfield group 21. Specifically, the fourth SF to tenth SF are set in the candidate gradation setting memory 28 as the first determined subfield group 21 corresponding to the gradation level range 41-6. In this event, the first error diffusion part 38 determines a candidate subfield group (first SF to tenth SF) corresponding to the gradation level range 41-6 in a plurality of subfields (first SF to eleventh SF) with reference to the candidate gradation setting memory 28, and outputs a pixel signal including the candidate subfield group (first SF to tenth SF) to the display controller 5. The candidate subfield group (first SF to ninth SF includes the first determined subfield group 21 (fourth SF to tenth SF) and the first SF to third SF which make up the selected candidate subfield group 22.

In the plurality of gradation level ranges 41-1 to 41-8, the gradation level range 41-7 represents the range of gradation levels "249-255." When the gradation level of a pixel signal is included in the gradation level range 41-7, the fourth SF to eleventh SF are previously determined as the first determined subfield group 21. Specifically, the fourth SF to eleventh SF are set in the candidate gradation setting memory 28 as the first determined subfield group 21 corresponding to the gradation level range 41-7. In this event, the first error diffusion part 38 determines a candidate subfield group (first SF to eleventh SF) corresponding to the gradation level range 41-7 in a plurality of subfields (first SF to eleventh SF) with reference to the candidate gradation setting memory 28, and outputs a pixel signal including the candidate subfield group (first SF to eleventh SF) to the display controller 5. The candidate subfield group (first SF to ninth SF) includes the first determined subfield group 21 (fourth SF to eleventh SF) and the first SF to third SF which make up the selected candidate subfield group 22.

In the plurality of gradation level ranges 41-1 to 41-8, the gradation level range 41-8 represents a range out of the gradation level ranges 41-1 to 41-7.

As shown in FIG. 31, the range selection memory 48 stores the first gradation level range, second gradation level range, and selection information for selecting one of the first gradation level range and second gradation level range in correspondence to one another. A gradation level range 41-$q$ (q=1, 2, 3, 4, 5, 6) as the first gradation level range represents a flag "0," and a gradation level range 41-($q$+1) represents a flag "1." The selection information indicates the flag "0" or "1."

For example, the first error diffusion part 38 references the candidate gradation setting memory 28, and further references the range selection memory 48 when the gradation level of a pixel signal is included in the gradation level 41-8 between the gradation level range 41-6 and gradation level range 41-7.

When the flag represented by the selection information corresponding to the first gradation level range (gradation level range 41-6) and second gradation level range (gradation level range 41-7) is "0," the first error diffusion part 38 regards the gradation level of the pixel signal as a spurious gradation level, and sets it at a gradation level "191" which is an upper limit value of the gradation levels "185-191" represented by the gradation level range 41-6, and selects the gradation level range 41-6. Upon selection of the gradation level range 41-6, the first error diffusion part 38 determines a candidate subfield group (first SF to tenth SF) corresponding to the gradation level range 41-6 in the plurality of subfields (first SF to tenth SF). In this event, the first error diffusion part 38 outputs a pixel signal including the candidate subfield group (first SF to tenth SF) to the display controller 5. The gradation level of the pixel signal output from the first error diffusion part 38 represents 191.

When the flag represented by the selection information corresponding to the first gradation level range (gradation level range 41-6) and second gradation level range (gradation level range 41-7) is "1," the first error diffusion part 38 regards the gradation level of the pixel signal as a spurious gradation level, and sets it at a gradation level "249" which is an lower limit value of the gradation levels "249-255" represented by the gradation level range 41-7, and selects the gradation level range 41-7. Upon selection of the gradation level range 41-7, the first error diffusion part 38 determines a candidate subfield group (first SF to eleventh SF) corresponding to the gradation level range 41-7 in the plurality of subfields (first SF to eleventh SF). In this event, the first error diffusion part 38 outputs a pixel signal including the candidate subfield group (first SF to tenth SF) to the display controller 5. The gradation level of the pixel signal output from the first error diffusion part 38 represents 249.

As shown in FIG. 30, the candidate gradation setting memory 29 stores a plurality of gradation level ranges 42-1 to 42-7, and a plurality of subfields (first SF to m-th SF) in correspondence to each other.

Like the first embodiment, the above-mentioned m is assumed to be 11 (m=11). The first SF, second SF, third SF, fourth SF, fifth SF, sixth SF, seventh SF, eighth SF, ninth SF, tenth SF, and eleventh SF stored in the candidate gradation setting memory 29 represent gradation levels "1," "2," "4," "7," "11," "17," "24," "32," "41," "52," and In the plurality of gradation level ranges 42-1 to 42-7, the gradation level range 42-1 represents the range of gradation levels "0-42." When the gradation level of a pixel signal is included in the gradation level range 42-1, the gradation level is relatively low, so that it is not necessary to previously determine a subfield group (first determined subfield group 21) which has been set to a gradation level representative of lit state (other than black). In other words, the first determined subfield group 21 corresponding to the gradation level range 42-1 need not be set in the candidate gradation setting memory 29. In this event, the second error diffusion part 39 outputs a pixel signal to the display controller 5 with reference to the candidate gradation setting memory 29.

In the plurality of gradation level ranges 42-1 to 42-7, the gradation level range 42-2 represents the range of gradation levels "50-66." When the gradation level of a pixel signal is included in the gradation level range 42-2, the sixth SF and seventh SF are previously determined as a subfield group which has been set to a gradation level representative of lit state (other than black). Specifically, the sixth SF and seventh SF are set in the candidate gradation setting memory 29 as the first determined subfield group 21 corresponding to the gradation level range 42-2. In this event, the second error diffusion part 39 determines a candidate subfield group (first SF to seventh SF) corresponding to the gradation level range 42-2 in a plurality of subfields (first SF to eleventh SF) with reference to the candidate gradation setting memory 29, and outputs a pixel signal including the candidate subfield group (first SF to seventh SF) to the display controller 5. The candidate subfield group (first SF to seventh SF) includes the first determined subfield group 21 (sixth SF, seventh SF), and the first SF to fifth SF which make up a selected candidate subfield group 22.

In the plurality of gradation level ranges 42-1 to 42-7, the gradation level range 42-3 represents the range of gradation levels "82-98." When the gradation level of a pixel signal is included in the gradation level range 42-3, the sixth SF, seventh SF, and eighth SF are previously determined as a subfield group which has been set to a gradation level representative of lit state (other than black). Specifically, the sixth SF, seventh SF, and eighth SF are set in the candidate gradation setting memory 29 as the first determined subfield group 21 corresponding to the gradation level range 42-3. In this event, the second error diffusion part 39 determines a candidate subfield group (first SF to eighth SF) corresponding to the gradation level range 42-3 in a plurality of subfields (first SF to eleventh SF) with reference to the candidate gradation setting memory 29, and outputs a pixel signal including the candidate subfield group (first SF to eighth SF) to the display controller 5. The candidate subfield group (first SF to eighth SF) includes the first determined subfield group 21 (sixth SF, seventh SF, eighth SF) and the first SF to fifth SF which make up a selected candidate subfield group 22.

In the plurality of gradation level ranges 42-1 to 42-7, the gradation level range 42-4 represents the range of gradation levels "123-139." When the gradation level of a pixel signal is included in the gradation level range 42-4, the sixth SF, seventh SF, eighth SF, and ninth SF are previously determined as a subfield group which has been set to a gradation level representative of lit state (other than black). Specifically, the sixth SF, seventh SF, eighth SF, and ninth SF are set in the candidate gradation setting memory 29 as the first determined subfield group 21 corresponding to the gradation level range 42-4. In this event, the second error diffusion part 39 determines a candidate subfield group (first SF to ninth SF) corresponding to the gradation level range 42-4 in a plurality of subfields (first SF to eleventh SF) with reference to the candidate gradation setting memory 29, and outputs a pixel signal including the candidate subfield group (first SF to ninth SF) to the display controller 5. The candidate subfield group (first SF to ninth SF) includes the first determined subfield group 21 (sixth SF to ninth SF) and the first SF to fifth SF which make up a selected candidate subfield group 22.

In the plurality of gradation level ranges 42-1 to 42-7, the gradation level range 42-5 represents the range of gradation levels "175-191." When the gradation level of a pixel signal is included in the gradation level range 42-5, the sixth SF to tenth SF are previously determined as a subfield group which has been set to a gradation level representative of lit state (other than black). Specifically, the sixth SF to tenth SF are set in the candidate gradation setting memory 29 as the first determined subfield group 21 corresponding to the gradation level range 42-5. In this event, the second error diffusion part 39 determines a candidate subfield group (first SF to tenth SF) corresponding to the gradation level range 42-5 in a plurality of subfields (first SF to eleventh SF) with reference to the candidate gradation setting memory 29, and outputs a pixel signal including the candidate subfield group (first SF to tenth SF) to the display controller 5. The candidate subfield group (first SF to tenth SF) includes the first determined subfield group 21 (sixth SF to tenth SF) and the first SF to fifth SF which make up a selected candidate subfield group 22.

In the plurality of gradation level ranges 42-1 to 42-7, the gradation level range 42-6 represents the range of gradation levels "239-255." When the gradation level of a pixel signal is included in the gradation level range 42-6, the sixth SF to eleventh SF are previously determined as a subfield group which has been set to a gradation level representative of lit state (other than black). Specifically, the sixth SF to eleventh SF are set in the candidate gradation setting memory 29 as the first determined subfield group 21 corresponding to the gradation level range 42-6. In this event, the second error diffusion part 39 determines a candidate subfield group (first SF to eleventh SF) corresponding to the gradation level range 42-6 in a plurality of subfields (first SF to eleventh SF) with reference to the candidate gradation setting memory 29, and outputs a pixel signal including the candidate subfield group (first SF to eleventh SF) to the display controller 5. The candidate subfield group (first SF to eleventh SF) includes the first determined subfield group 21 (sixth SF to eleventh SF) and the first SF to fifth SF which make up a selected candidate subfield group 22.

In the plurality of gradation level ranges 42-1 to 42-7, the gradation level range 42-7 represents a range out of the gradation level ranges 42-1 to 42-6.

As shown in FIG. 32, the range selection memory 49 stores the first gradation level range, second gradation level range, and selection information for selecting one of the first gradation level range and second gradation level range in correspondence to one another. A gradation level range 42-*q* (q=1, 2, 3, 4, 5) as the first gradation level range represents a flag "0," and a gradation level range 42-(*q*+1) represents a flag "1." The selection information indicates the flag "0" or "1."

For example, the second error diffusion part 39 references the candidate gradation setting memory 29, and further references the range selection memory 49 when the gradation level of a pixel signal is included in the gradation level 42-7 between the gradation level range 42-5 and gradation level range 42-6.

When the flag represented by the selection information corresponding to the first gradation level range (gradation level range 42-5) and second gradation level range (gradation level range 42-6) is "0," the second error diffusion part 39 regards the gradation level of the pixel signal as a spurious gradation level, and sets it at a gradation level "191" which is an upper limit value of the gradation levels "171-191" represented by the gradation level range 42-5, and selects the gradation level range 42-5. Upon selection of the gradation level range 42-5, the second error diffusion part 39 determines a candidate subfield group (first SF to tenth SF) corresponding to the gradation level range 42-5 in the plurality of subfields (first SF to tenth SF). In this event, the second error diffusion part 39 outputs a pixel signal including the candidate subfield group (first SF to tenth SF) to the display controller 5. The gradation level of the pixel signal output from the first error diffusion part 38 represents 191.

When the flag represented by the selection information corresponding to the first gradation level range (gradation level range 42-5) and second gradation level range (gradation level range 42-6) is "1," the second error diffusion part 39 regards the gradation level of the pixel signal as a spurious gradation level, and sets it at a gradation level "239" which is a lower limit value of the gradation levels "239-255" represented by the gradation level range 42-6, and selects the gradation level range 42-6. Upon selection of the gradation level range 42-6, the second error diffusion part 39 determines a candidate subfield group (first SF to eleventh SF) corresponding to the gradation level range 42-6 in the plurality of subfields (first SF to eleventh SF). In this event, the second error diffusion part 39 outputs a pixel signal including the candidate subfield group (first SF to tenth SF) to the display controller 5. The gradation level of the pixel signal output from the second error diffusion part 39 represents 239.

The display controller 5 controls the display part 2 to display an image from the pixel signal output from the error diffusion processing decision part 37, first error diffusion part 38, or second error diffusion part 39 as an input signal (pixel Pi,j). Specifically, when no error diffusion processing is performed for a pixel signal, the pixel signal is output from the error diffusion processing decision part 37, so that the display controller 5 controls the display part 2 to display an image based on this pixel signal. When the pixel signal is subjected to the intense error diffusion processing, the pixel signal is output from the first error diffusion part 38, so that the display controller 5 controls the display part 2 to display an image based on this display signal. When the pixel signal is subjected to the feeble error diffusion processing, the pixel signal is output from the second error diffusion part 39, so that the display controller 5 controls the display part 2 to display an image based on this pixel signal.

In the display device 10 according to the third embodiment, the dynamic false contour reducing circuit 1 comprises a plurality of false contour magnitude level based diffusion processing parts (error diffusion processing parts) 30 for performing the error diffusion processing for a pixel signal in accordance with the level of the viewed false contour magnitude $f_2$ of the pixel signal, such that the false contour magnitude level based error diffusion processing parts 30 perform error diffusion processing for a pixel signal in accordance with the level of the viewed false contour magnitude $f_2$ of the pixel signal, thus making it possible to more suitably reduce the dynamic false contour 100. In other words, the display device 10 according to the third embodiment of the present invention eliminates a degraded image quality of an image (moving image, still image) displayed on the display part 2.

While the foregoing third embodiment has been described in connection with an example in which the error diffusion processing is applied to a wider range which is equal irrespective of whether the level of the false contour magnitude $f_2$ is high or moderate (increase of four pixels each on the left and right sides for both cases), the error diffusion processing may be applied to a wider range, for example, when the level of the false contour magnitude $f_2$ is higher.

Also, while the foregoing third embodiment has been described in connection with an example in which the error diffusion processing is performed for a pixel signal in a manner depending on the level of the viewed false contour magnitude $f_2$ of a pixel signal, the error diffusion processing may be performed for a pixel signal in a manner depending on the false contour magnitude $f_1$ of a pixel signal. In this alternative, the display device 10 need not comprise each visual sensitivity conversion part 16 and visual sensitivity setting memory 9.

While the error diffusion takes place in all the gradations when it is performed in a manner depending on the false contour magnitude $f_1$, the error diffusion is more likely to take place toward the lower gradation, i.e., darker gradation side, and on the contrary, is less likely to take place toward the higher gradation, i.e, brighter gradation side when it is performed in a manner depending on the viewed false contour magnitude $f_2$. This is because the false contour is generally more prominent in lower gradation levels and less prominent in higher gradation levels.

This application is based on Japanese Patent Applications Nos. 2003-442208 and 2004-281060 which are herein incorporated by reference.

What is claimed is:

1. A dynamic false contour reducing circuit comprising:

a first coding part which receives an input signal and generates a first coding signal by performing a first coding process on said input signal;

a first false contour detecting part which detects a first false contour intensity on a pixel of interest produced when an image is displayed on said pixel of interest based on said first coding signal;

a second coding part which receives the input signal and generates a second coding signal by performing a second coding process on said input signal;

a second false contour detecting part which detects a second false contour intensity on the pixel of interest produced when an image is displayed on said pixel of interest based on said second coding signal;

a selecting part which compares said first and second false contour intensities and selects one of said first and second coding signals which has a lower intensity between said first and second false contour intensities; and a display control part which controls a display part so that an image is displayed based on the said selected one of said first and second coding signals.

2. A dynamic false contour reducing circuit according to claim 1, further comprising an error diffusion part which sets a first gradation level range, a second gradation level range higher in gradation level than said first gradation level range, and a third gradation level range between said first and second gradation level ranges, and performs a false contour processing on said input signal using said input signal when a gradation level of said input signal is within said first gradation level range or said second gradation level range, and performs the false contour processing on said input signal using a value in said first gradation level range and a value in said second gradation level range when the gradation level of said input signal is within said third gradation level range, wherein an output signal of said error diffusion component is supplied to said first and second coding components.

3. A dynamic false contour reducing circuit according to claim 2, wherein said gradation processing part performs the gradation processing on said input signal using a maximum value in said first gradation level range and a minimum value in said second gradation level range when the level of said input signal is within said third gradation level range.

4. A dynamic false contour reducing circuit comprising:

a false contour detecting part which receives an input signal for displaying an image on a pixel of interest and detects a false contour intensity on a pixel of interest produced when the image is displayed on said pixel of interest based on said input signal; and an error diffusion processing part which sets a first gradation level range, a second gradation level range higher in gradation level than said first gradation level range, and a third gradation level range between said first and second gradation level ranges, and performs a false contour processing on said input signal using said input signal only when a gradation level of said input signal is within said first gradation level range or said second gradation level range, and performs the false contour processing on said input signal using a value in said first gradation level range and said second gradation level range only when the gradation level of said input signal is within said third gradation level range, wherein said error diffusion processing part performs an error diffusion processing on said input signal in a manner corresponding to a level of said false contour intensity.

5. A dynamic false contour reducing circuit comprising;

a coding part which receives the input signal and performs a subfield coding process based on said input signal so that a sum value of gradation levels of a plurality of subfields equals a gradation level of a pixel of interest;

a false contour detecting part which generates a contour detection value for each of said plurality of subfields by detecting a contour of a pixel of interest and surrounding pixels of said pixel of interest;

an adding part which calculates a false contour intensity by performing a weighted addition of contour detection values of all of said plurality of sub-fields;

an error diffusion processing part which performs an error diffusion processing on said input signal in a manner corresponding to a level of said false contour intensity; and a display control part which controls a display part so that an image is displayed based on the input signal after the error diffusion processing by said error diffusion processing part.

* * * * *